US012486654B2

(12) United States Patent
Knuth

(10) Patent No.: US 12,486,654 B2
(45) Date of Patent: Dec. 2, 2025

(54) DRAIN TRAP

(71) Applicant: James Knuth, Barneveld, NY (US)

(72) Inventor: James Knuth, Barneveld, NY (US)

( * ) Notice: Subject to any disclaimer, the term of this patent is extended or adjusted under 35 U.S.C. 154(b) by 171 days.

(21) Appl. No.: 18/452,195

(22) Filed: Aug. 18, 2023

(65) Prior Publication Data

US 2025/0059746 A1 Feb. 20, 2025

(51) Int. Cl.
*E03C 1/288* (2006.01)
*E03F 5/04* (2006.01)

(52) U.S. Cl.
CPC ..... *E03C 1/288* (2013.01); *E03F 5/0408* (2013.01)

(58) Field of Classification Search
CPC ..... E03C 1/288; E03C 1/28; E03F 5/0408
See application file for complete search history.

(56) References Cited

U.S. PATENT DOCUMENTS 460,557 A * 10/1891 Carroll ..... E03C 1/29 4/679
3,751,734 A * 8/1973 Lumadue ..... E03C 1/29 4/679
5,662,138 A * 9/1997 Wang ..... E03F 5/042 137/533.15
6,319,397 B1 * 11/2001 Su ..... E03F 5/0405 210/163
D462,256 S 9/2002 Jaynes
D511,372 S 11/2005 Selover
D655,792 S 3/2012 Teixeira
D729,908 S 5/2015 Lohmann
D758,554 S 6/2016 Lohmann
D899,568 S 10/2020 Ball et al.
D972,090 S 12/2022 Liu
D1,029,989 S 6/2024 Speak
D1,031,943 S 6/2024 Ying
D1,032,798 S 6/2024 Chen
D1,050,443 S 11/2024 Kondo et al.
(Continued)

FOREIGN PATENT DOCUMENTS

AU 2011100510 A4 6/2011
CN 1519441 A 8/2004
(Continued)

OTHER PUBLICATIONS

Easy Access (Villeroy & Boch catalogue p. 120), Villeroy & Boch, https://www.villeroy-boch.asia/fileadmin/picdb/produkte/bad/ebooks-fl/WOB%202021%20NME/index.html.
(Continued)

*Primary Examiner* — Huyen D Le
(74) *Attorney, Agent, or Firm* — Schmeiser, Olsen & Watts LLP; Victor J. Baranowski

(57) ABSTRACT

A drain trap includes an outer part including a circumferential wall, the outer part extending in an axial direction between an outer part upper end and an outer part lower end, the outer part including outer part radial threads proximate the outer part upper end, the outer part lower end forming a well configured to trap and retain fluid, the outer part further including at least one opening disposed in the circumferential wall, an inner part, and a rounded structure retained within the well. Fluid entering the drain trap accumulates in the well, and the fluid entering the drain trap is expelled from the drain trap through the at least one opening disposed in the circumferential wall.

22 Claims, 23 Drawing Sheets

(56) References Cited

U.S. PATENT DOCUMENTS

| | | | | |
|---|---|---|---|---|
| 2004/0163165 | A1 | 8/2004 | Ortiz et al. | |
| 2007/0017578 | A1* | 1/2007 | Dallmer | E03F 5/0408 137/362 |
| 2009/0077735 | A1 | 3/2009 | Dallmer | |
| 2009/0307837 | A1 | 12/2009 | Gan | |
| 2010/0071122 | A1 | 3/2010 | Li | |
| 2011/0296606 | A1* | 12/2011 | Wedi | E03F 5/0408 4/679 |
| 2012/0060275 | A1 | 3/2012 | Cheng | |
| 2018/0106025 | A1 | 4/2018 | Schuster | |
| 2018/0274218 | A1 | 9/2018 | Karnegie et al. | |
| 2019/0368185 | A1 | 12/2019 | Dirani | |
| 2020/0123749 | A1 | 4/2020 | Littlejohn | |

FOREIGN PATENT DOCUMENTS

| | | | |
|---|---|---|---|
| DE | 19947400 | A1 | 4/2001 |
| EP | 3495576 | A2 | 6/2019 |
| JP | 2021017725 | A | 2/2021 |
| KR | 3020080028122 | | 3/2009 |
| KR | 20190076198 | A | 7/2019 |
| NZ | 424630 | | 6/2019 |

OTHER PUBLICATIONS

LIPKA Round Golden Classic Jali 5" Floor Drain with Hinge & Hole, Lipka, https://lipkahome.com/collections/floor-drain/products/lipka-round-golden-classic-jali-5-floor-drain-with-hinge-hole.

Shower Drain Hair Catcher Bathroom Insert Floor Drain Backflow Preventer One Way Drain Valve Anti-Odor DrainStrainer for Bathtub Sink Sewer (Green), Amazon, https://www.amazon.in/Bathroom-Backflow-Preventer-Anti-Odor-Strainer/dp/B09L4PB7F5/ref=asc_df_B09L4PB7F5/?tag=googleshopdes-21&linkCode=df0&hvadid=586309038158&hvpos=&hvnetw=g&hvrand=8673466439673288524&hvpone=&hvptwo=&hvqmt=&hvdev=c&hvdvcmdl=&hvlocint=&hvlocphy=9062136&hvtargid=pla-1595097263699&th=1.

Japanese Anti-Odor Floor Drain Silicone Core Bathroom Sewer Anti-Odor Cover Bathroom Artifact Washing Machine Cover Odor Inner Core, SP Sauce, https://www.lazada.com.ph/products/japanese-anti-odor-floor-drain-silicone-core-bathroom-sewer-anti-odor-cover-bathroom-artifact-washing-machine-cover-odor-inner-core-i2447021268.html?spm=a204l.searchlist.list.24.36eb78bekrLMtg.

Drain Backflow Preventer, Kitchen Toilet Sewer Anti-Odor Floor Drain Core Plug & Play, One Way Valve for Pipes Tubes in Toilet Bathroom Floor Drain Seal with Filter Resist Smell Bugs, 3 Pack, FCS Bathroom, https://www.amazon.ae/Backflow-Preventer-Kitchen-Anti-Odor-Bathroom/dp/B07VWT1GW4.

Water Seal Trap 100 mm, Bird Out, https://www.amazon.in/Water-Seal-Trap-100-mm/dp/B09VT8XHQD/ref=asc_df_B09VT8XHQD/?tag=googleshopdes-21&linkCode=df0&hvadid=586176364995&hvpos=&hvnetw=g&hvrand=11797070580757939946&hvpone=&hvptwo=&hvqmt=&hvdev=c&hvdvcmdl=&hvlocint=&hvlocphy=9062136&hvtargid=pla-1651678303182&psc=1.

LIPKA Home Catalogue, pp. 1-48.

* cited by examiner

DRAIN TRAP

RELATED MATTERS

This application claims the benefit of the earlier filing date of U.S. Design patent application Ser. No. 29/850,492 filed Aug. 19, 2022 and titled "DRAIN TRAP," the entirety of which is incorporated herein by reference.

BACKGROUND

The subject matter disclosed herein relates generally to a drain trap. More particularly, the subject matter relates to a device and method for preventing gas or odor from a drain, such as a shower or floor drain.

SUMMARY

According to a described aspect, a drain trap includes an outer part including a circumferential wall, the outer part extending in an axial direction between an outer part upper end and an outer part lower end, the outer part including outer part radial threads proximate the outer part upper end, the outer part lower end forming a well configured to trap and retain fluid, the outer part further including at least one opening disposed in the circumferential wall. The drain trap further includes an inner part extending in the axial direction between an inner part upper end and an inner part lower end, the inner part including inner part radial threads proximate the inner part upper end configured to engage with the outer part radial threads of the outer part to attach the inner part to the outer part. The inner part upper end includes an upper opening and the inner part lower end includes a bottom opening such that fluid entering the inner part through the upper opening and leaving the inner part through the bottom opening is transferred into the well of the outer part when the inner part is attached to the outer part. The drain trap further includes a rounded structure retained within the well that is configured to float in the fluid. The rounded structure has a smaller dimension than a width of the well, and an equal or larger dimension than a width of the bottom opening of the inner part such that the rounded structure is prevented from rising in the well by the inner part lower end. Fluid entering the drain trap accumulates in the well, and the fluid entering the drain trap is expelled from the drain trap through the at least one opening disposed in the circumferential wall.

BRIEF DESCRIPTION OF THE DRAWINGS

The subject matter disclosed herein is distinctly claimed in the claims at the conclusion of the specification. The foregoing and other features and advantages are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

FIGS. 1-21 provide various views of component parts of a first drain trap 100 according to one embodiment.

Figure 1:
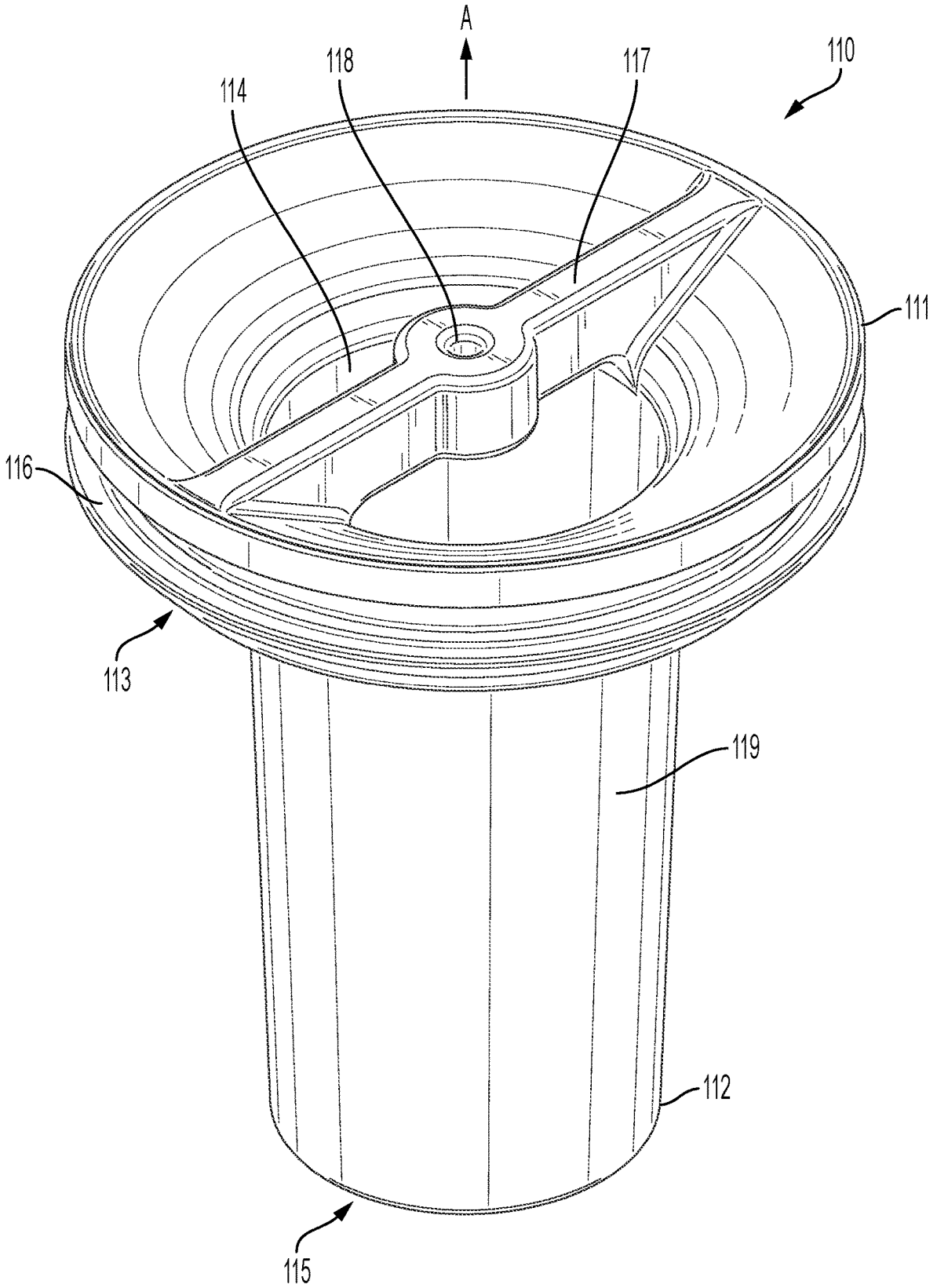
FIG. 1 is a perspective view of an inner part of a drain trap, according to one embodiment.
Figure 2:
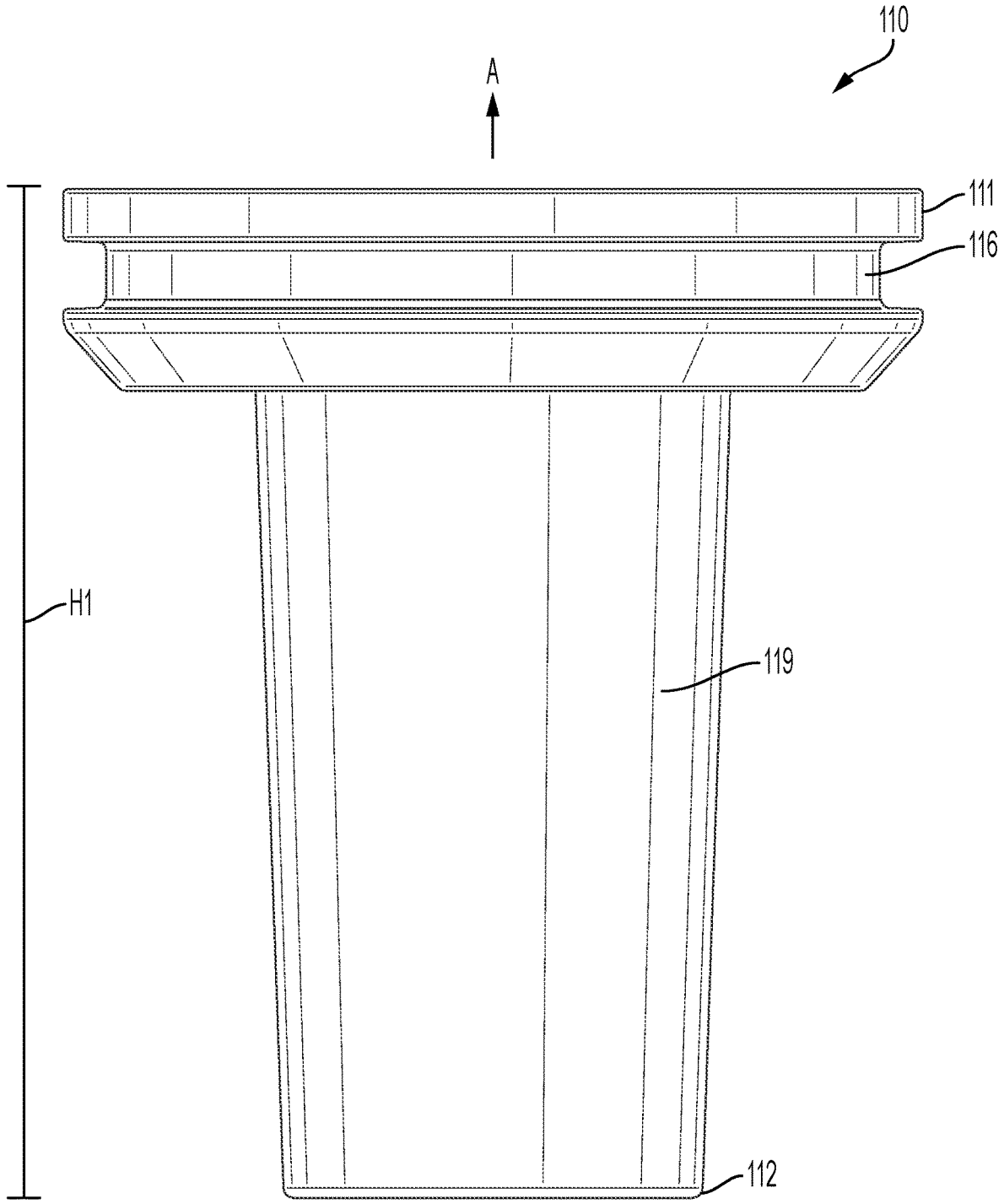
FIG. 2 is a front view of the inner part of the drain trap of FIG. 1, according to one embodiment.
Figure 3:
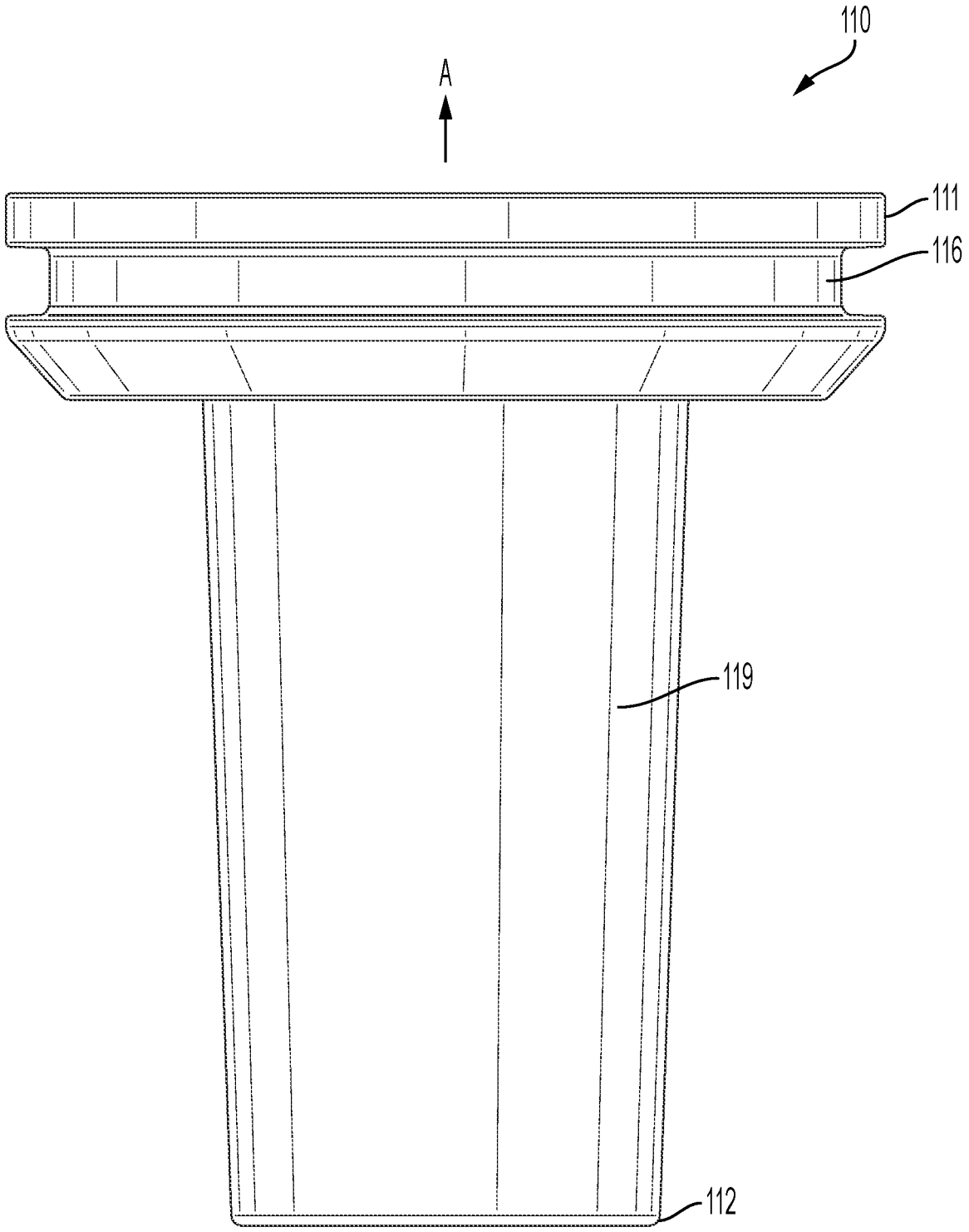
FIG. 3 is a left side view of the inner part of the drain trap of FIG. 1, according to one embodiment.
Figure 4:
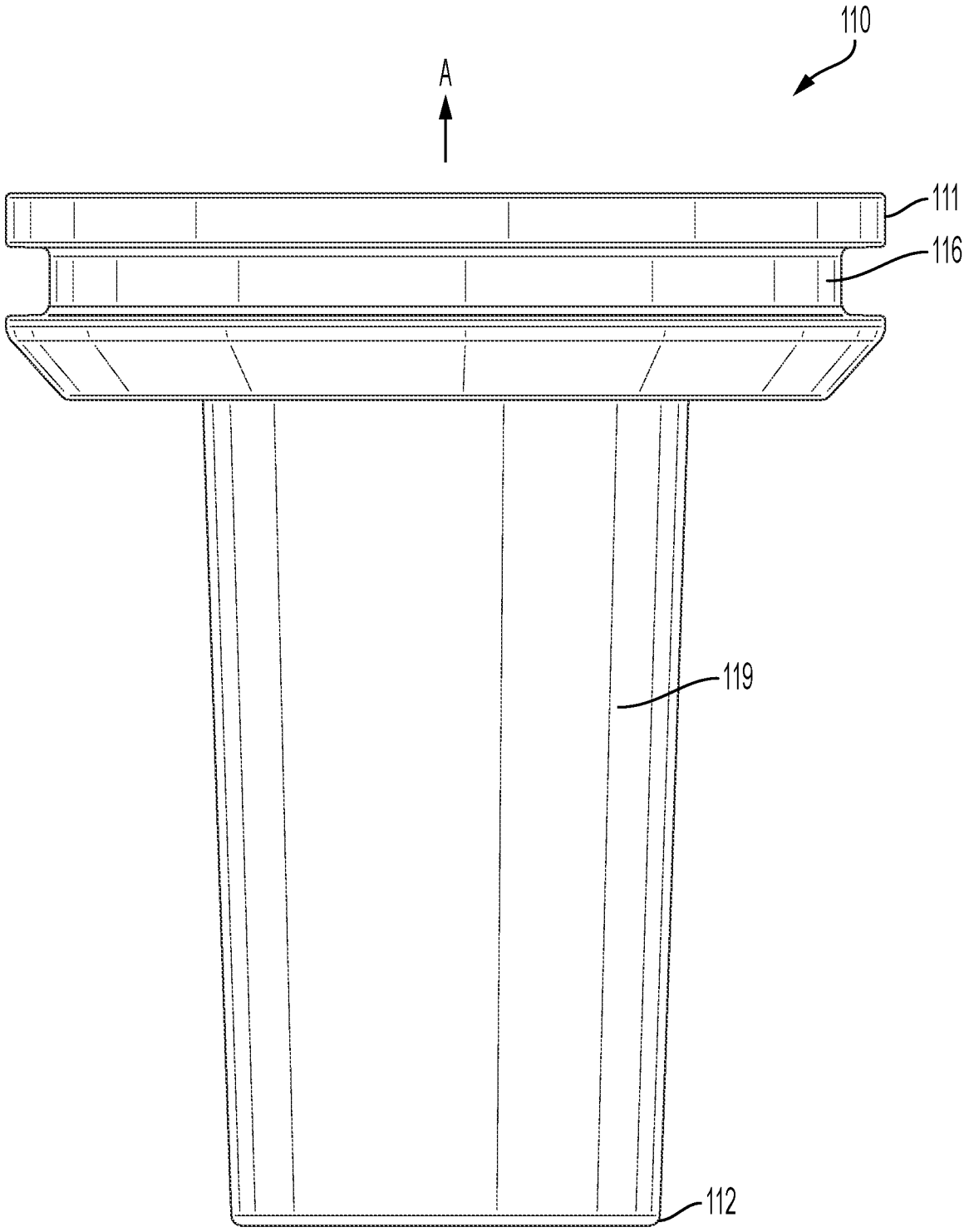
FIG. 4 is a right side view of the inner part of the drain trap of FIG. 1, according to one embodiment.
Figure 5:
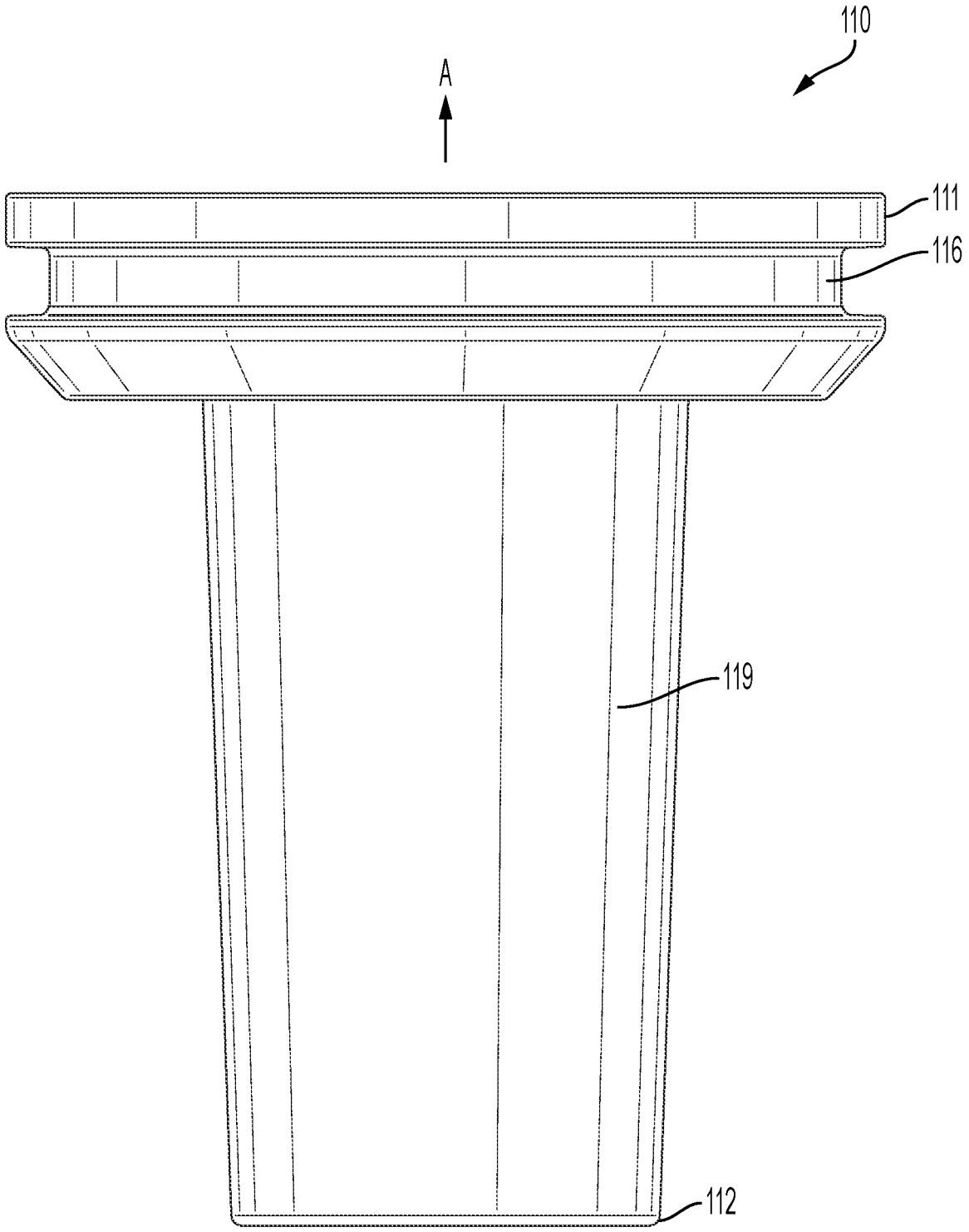
FIG. 5 is a rear view of the inner part of the drain trap of FIG. 1, according to one embodiment.
Figure 6:
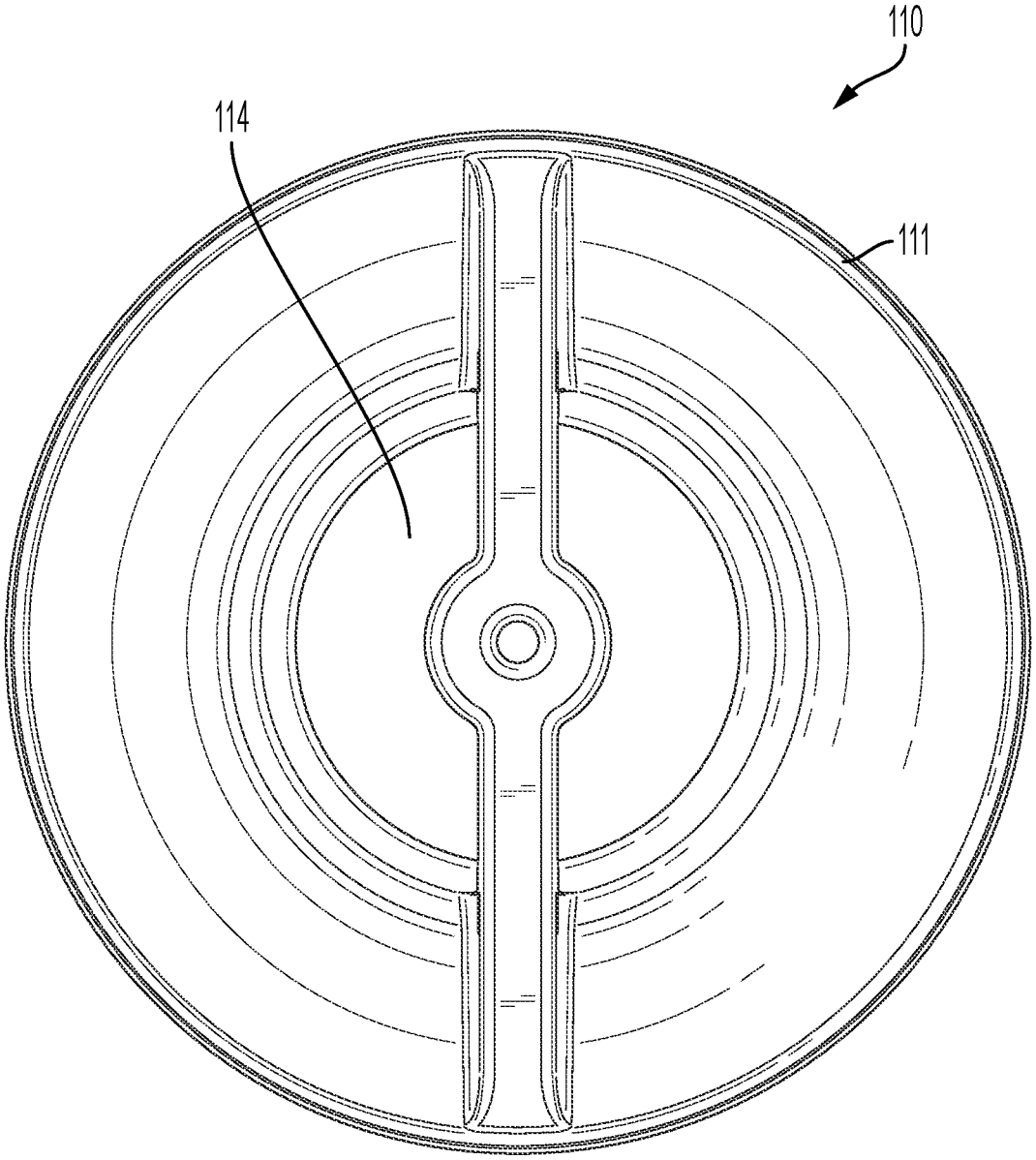
FIG. 6 is a top view of the inner part of the drain trap of FIG. 1, according to one embodiment.
Figure 7:
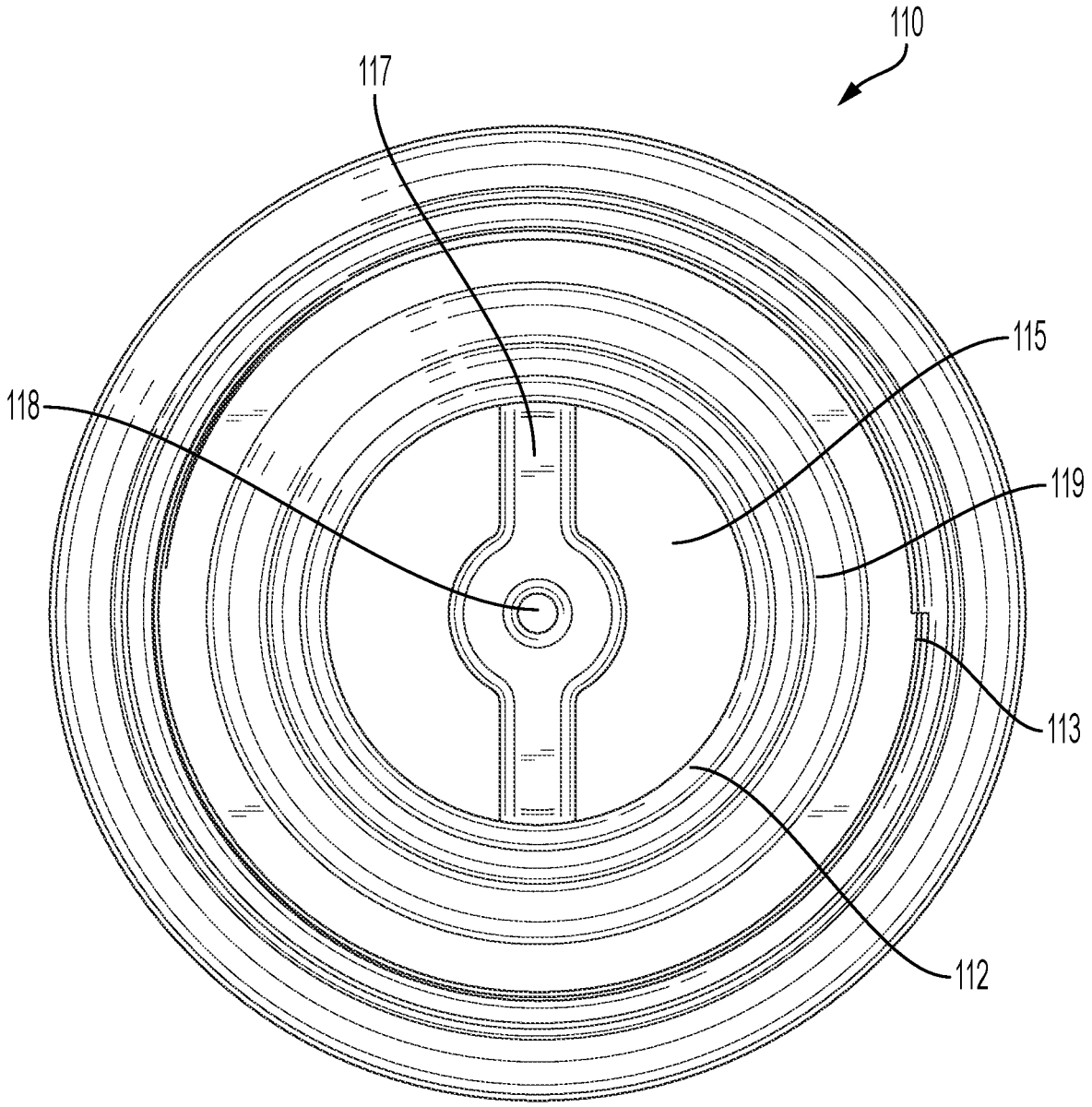
FIG. 7 is a bottom view of the inner part of the drain trap of FIG. 1, according to one embodiment.

FIGS. 1-7 are views of an inner part 110 of the drain trap 100. In particular, FIG. 1 is a perspective view of the inner part 110 of the drain trap 100, FIG. 2 is a front view of the inner part 110 of the drain trap 100, FIG. 3 is a left side view of the inner part 110 of the drain trap 100 of FIG. 1, FIG. 4 is a right side view of the inner part 110 of the drain trap 100, FIG. 5 is a rear view of the inner part 110 of the drain trap, FIG. 6 is a top view of the inner part 110 of the drain trap 100 of FIG. 1, and FIG. 7 is a bottom view of the inner part 110 of the drain trap 100.

As shown in FIGS. 1-7, the inner part 110 extends in an axial direction A between an inner part upper end 111 and an inner part lower end 112. The inner part 110 includes inner part radial threads 113 (shown in FIGS. 1 and 7) proximate the inner part upper end 111 configured to engage with outer part radial threads (shown in FIGS. 8-14) of the outer part 120 to attach the inner part 110 to the outer part 120. The inner part upper end 111 includes an upper opening 114 and the inner part lower end 112 includes a bottom opening 115 such that fluid entering the inner part 110 through the upper opening 114 and leaving the inner part 110 through the bottom opening 115 is transferred into a well (shown in FIGS. 8-14) of the outer part 120 when the inner part 110 is attached to the outer part 120.

At least one of the inner part 110 and the outer part 120 includes a radial O-ring seat 116 for receiving an O-ring (not shown), where the O-ring is configured to create a seal between the drain trap 100 and a fluid conduit (not shown). In the embodiment shown, the inner part 110 includes the O-ring seat 116. In the embodiment shown, the O-ring seat 116 is includes a circumferential channel configured to receive the O-ring seal.

The upper opening 114 of the inner part upper end 111 of the inner part 110 includes a cross beam structure 117 including an opening 118 configured to mount a screen (not shown). The upper opening 114 is configured to receive fluid from a reservoir into the drain trap 100 through the mounted screen. The upper opening 114 may include a conical structure which is funnel shaped and configured to funnel water through the inner part 110. The cross beam structure 117 extends across the conical structure. The opening 118 may include internal threads for receiving a bolt or screw for attaching the screen.

The inner part 110 includes a circumferential wall 119. The circumferential wall 119 of the inner part 110 includes a first height H1. The circumferential wall 119 may form a cylinder with a constant outer diameter along the height H1. Alternatively, as shown, the circumferential wall 119 may have a reduced outer diameter as the circumferential wall 119 extends away from the inner part upper end 111. Various shapes are contemplated for the circumferential wall 119. While the circumferential wall includes a circular circumference at any given location along the height H1, other embodiments may include varying cross sectional shapes.

Figure 8:
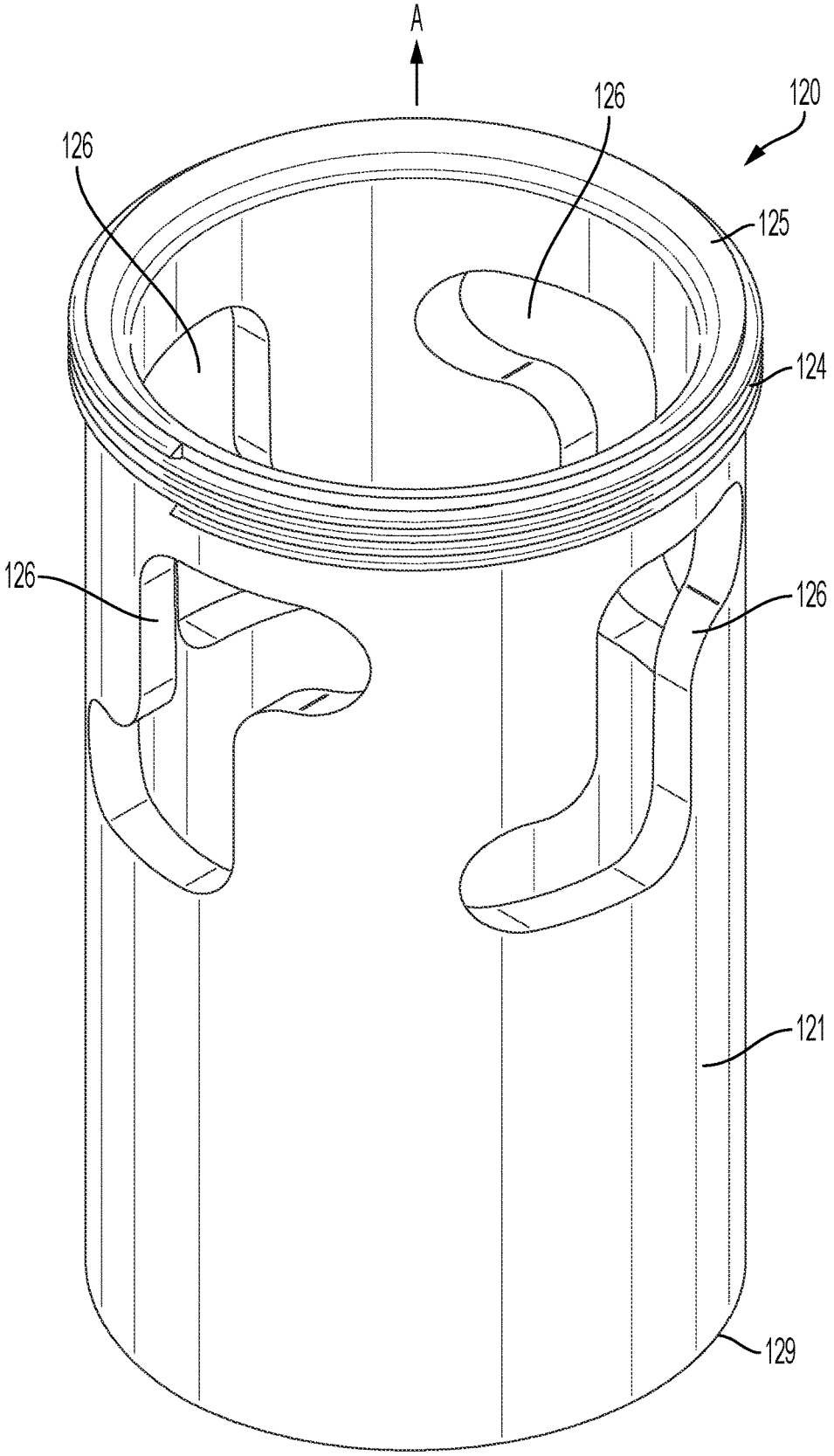
FIG. 8 is a perspective view of an outer part of the drain trap of FIG. 1, according to one embodiment.
Figure 9:
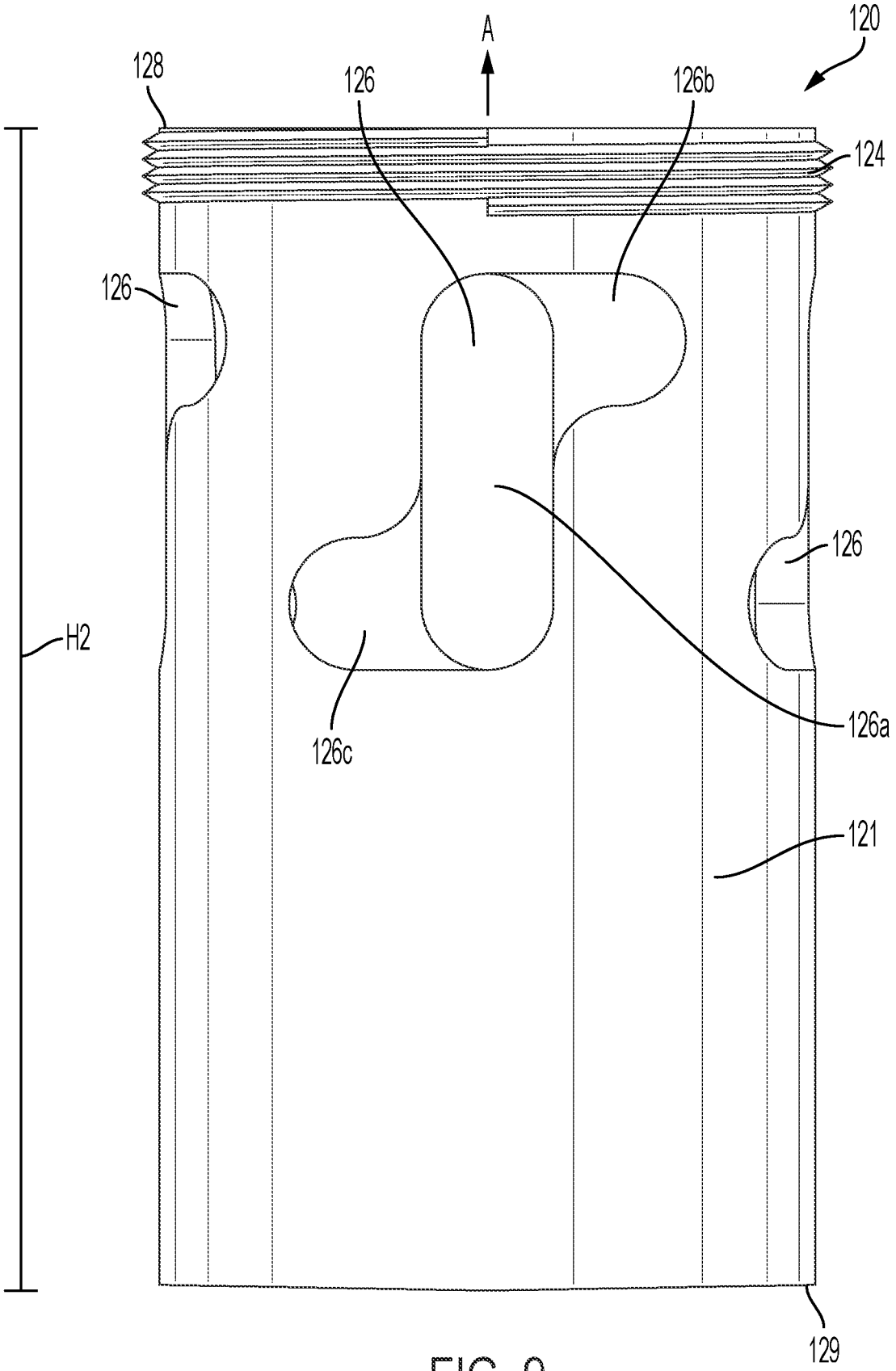
FIG. 9 is a front view of the outer part of the drain trap of FIG. 1, according to one embodiment.
Figure 10:
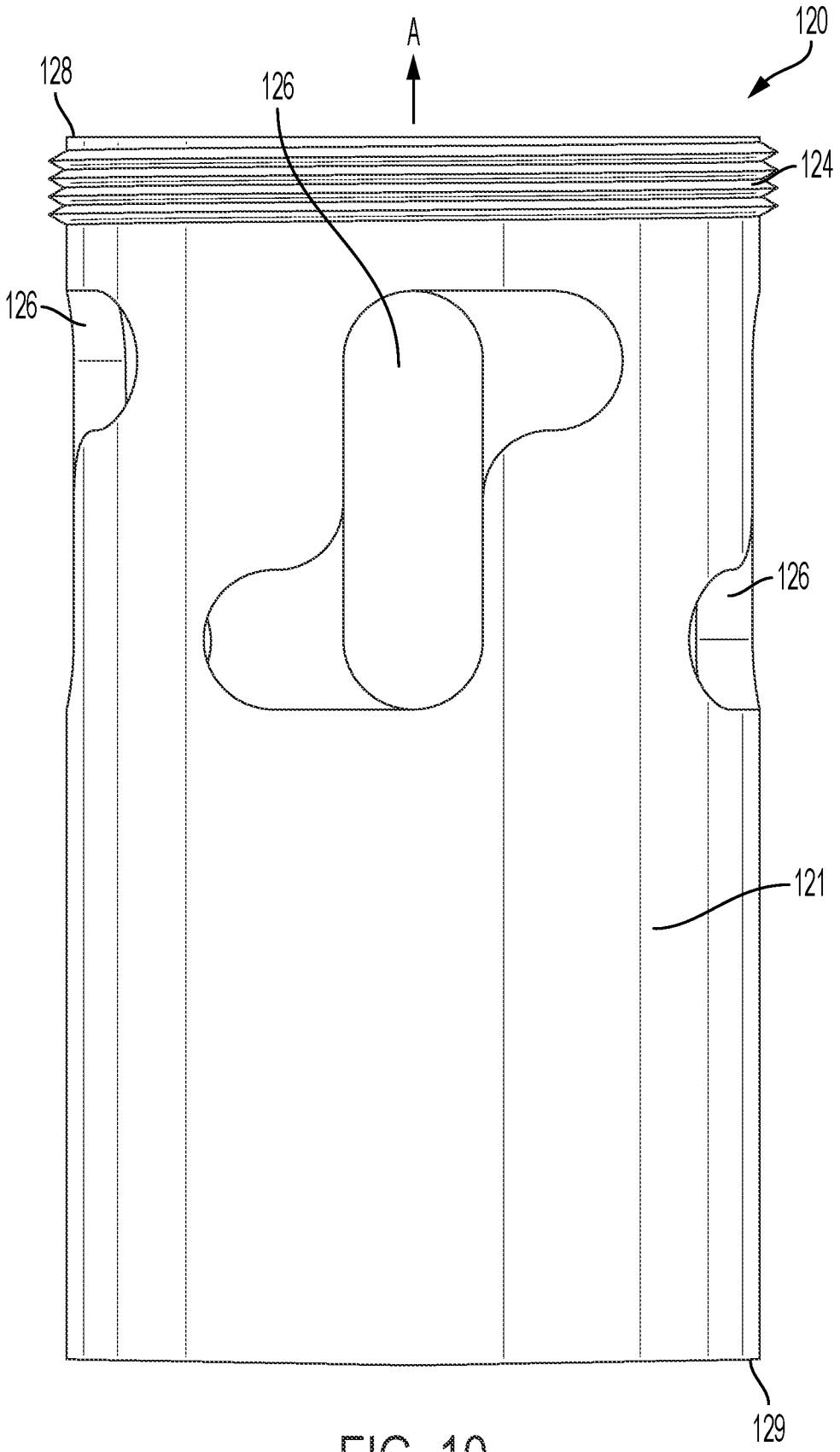
FIG. 10 is a left side view of the outer part of the drain trap of FIG. 1, according to one embodiment.
Figure 11:
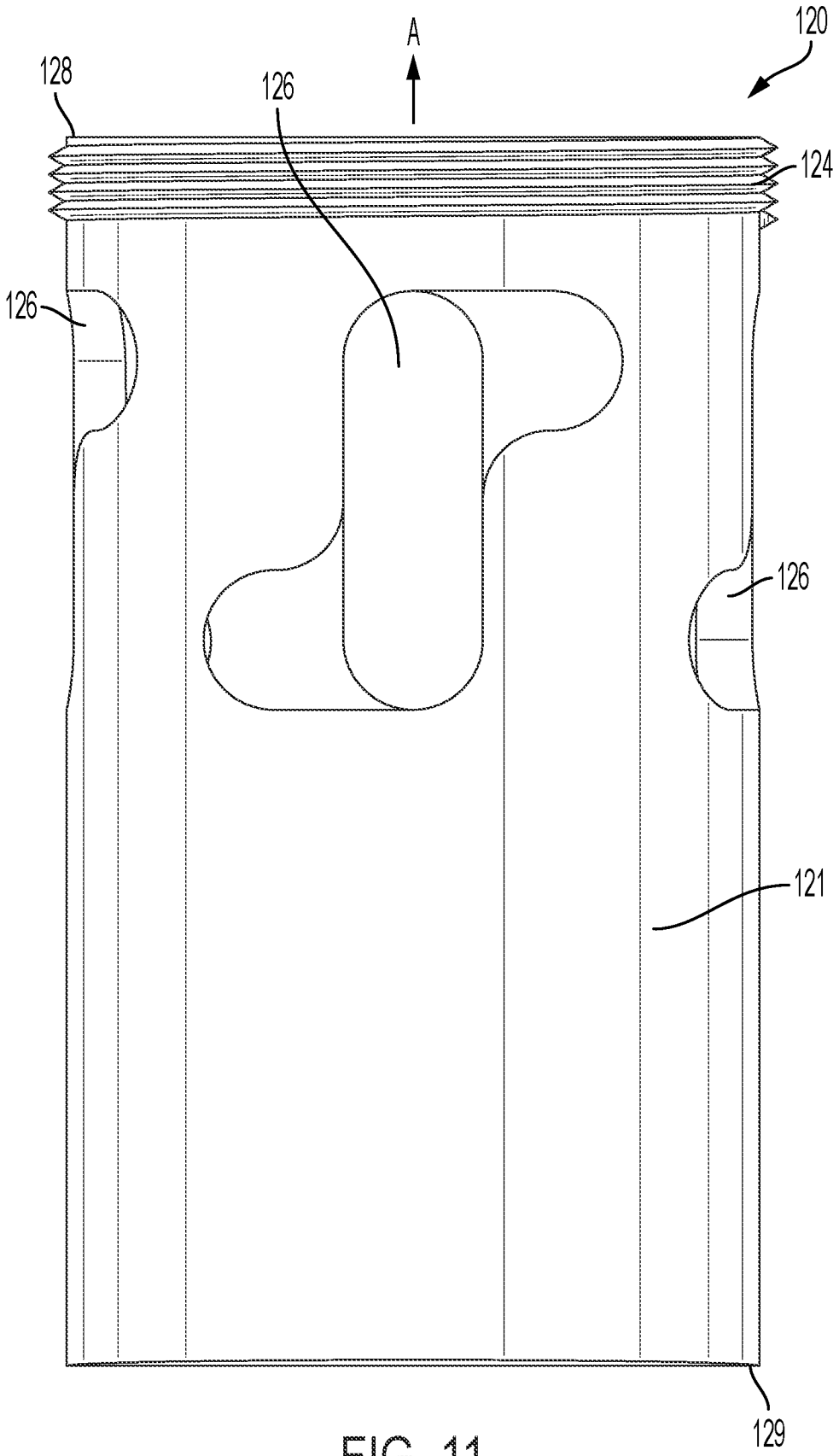
FIG. 11 is a right side view of the outer part of the drain trap of FIG. 1, according to one embodiment.
Figure 12:
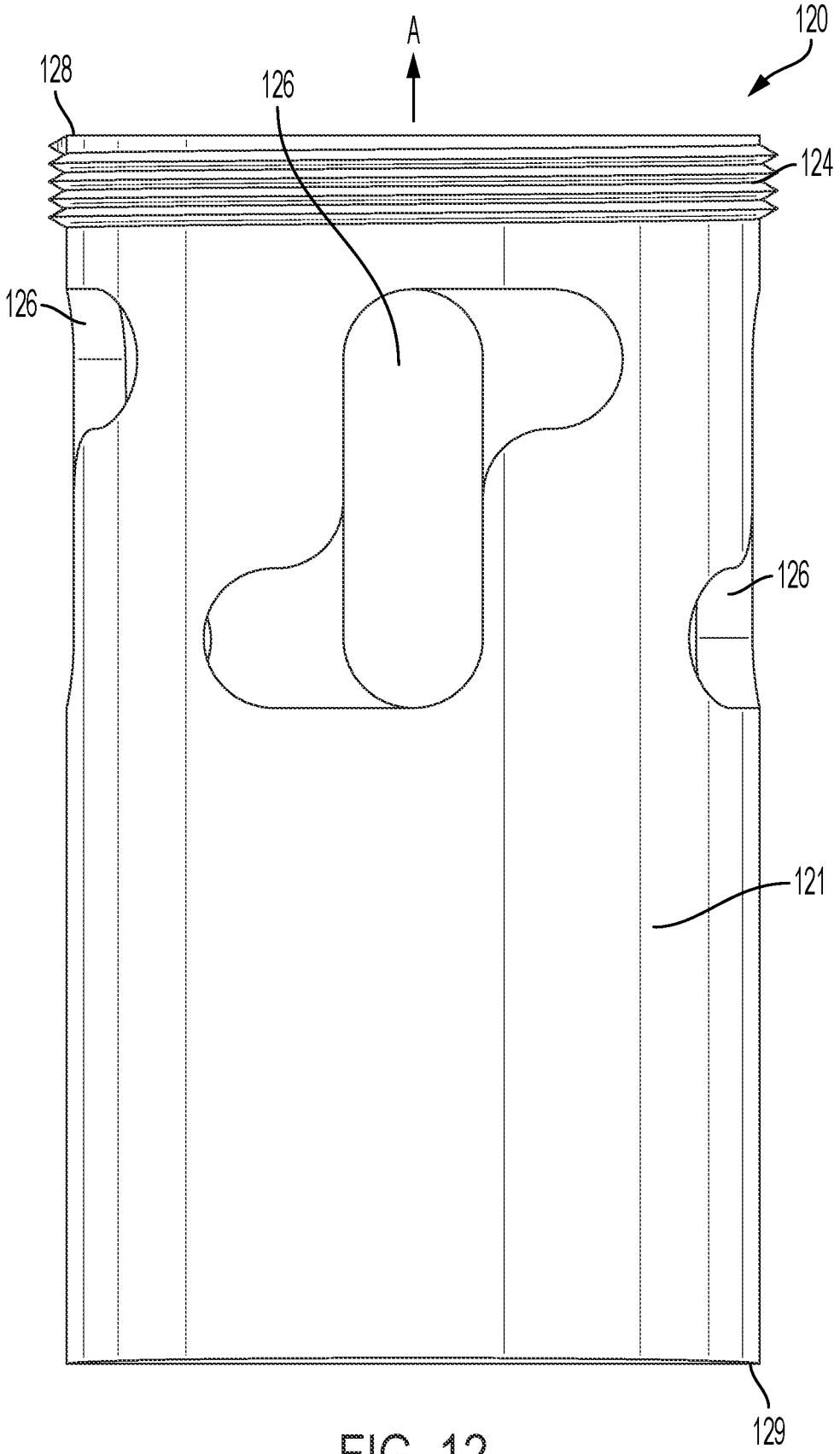
FIG. 12 is a rear view of the outer part of the drain trap of FIG. 1, according to one embodiment.
Figure 13:
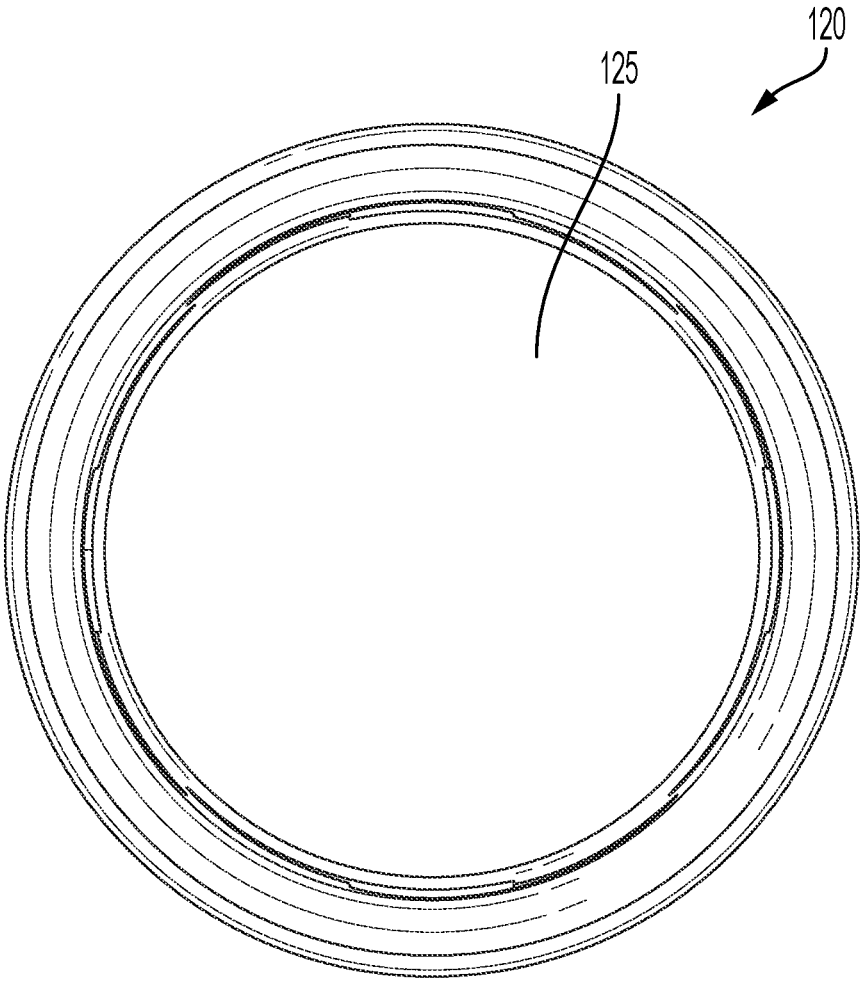
FIG. 13 is a top view of the outer part of the drain trap of FIG. 1, according to one embodiment.
Figure 14:
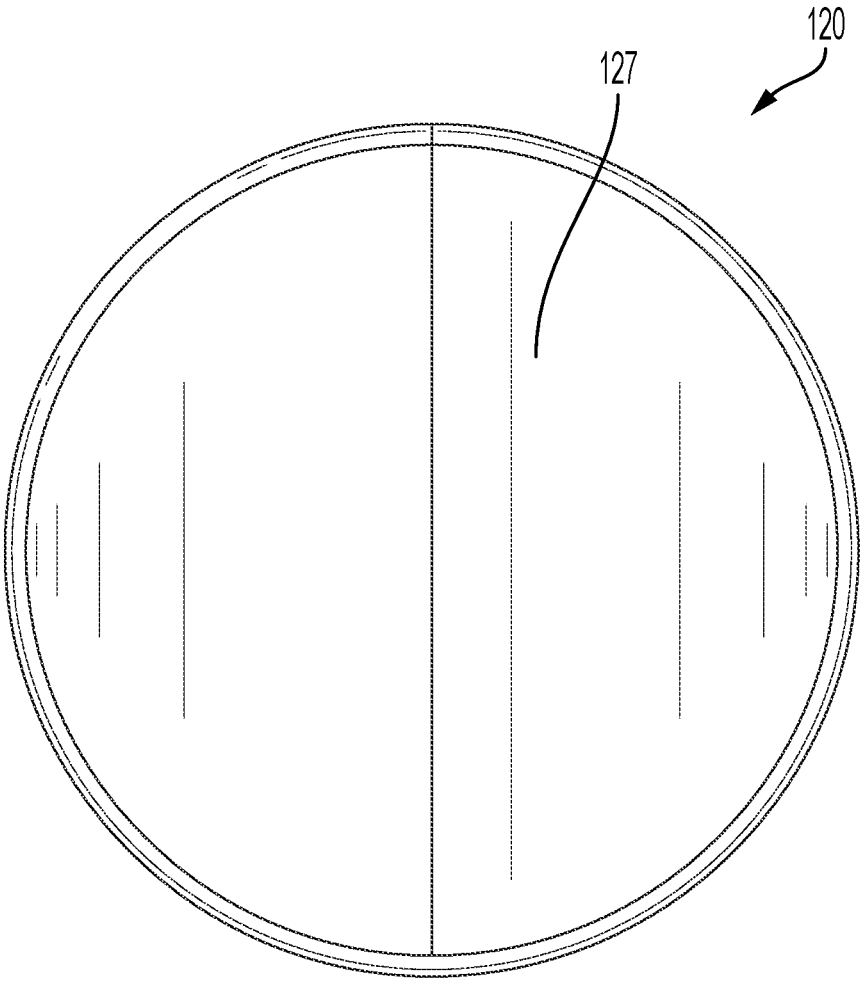
FIG. 14 is a bottom view of the outer part of the drain trap of FIG. 1, according to one embodiment.

FIGS. 8-14 are views of an outer part 120 of the drain trap 100. Specifically, FIG. 8 is a perspective view of the outer part 120 of the drain trap 100, FIG. 9 is a front view of the outer part 120 of the drain trap 100, FIG. 10 is a left side view of the outer part 120 of the drain trap 100, FIG. 11 is a right side view of the outer part 120 of the drain trap 100, FIG. 12 is a rear view of the outer part 120 of the drain trap 100, FIG. 13 is a top view of the outer part 120 of the drain trap 100, and FIG. 14 is a bottom view of the outer part 120 of the drain trap 100.

The outer part 120 including a circumferential wall 121. The circumferential 121 wall of the outer part 120 includes a second height H2. The second height H2 is larger than the first height H1 of the inner part 110. Thus, the outer part 120 extends in the axial direction A between an outer part upper end 128 and an outer part lower end 129.

The outer part 120 includes outer part radial threads 124 proximate the outer part upper end 128. The outer part radial threads 124 shown are external threads surrounding the exterior of the circumferential wall 121 proximate the outer part upper end 128, and may be configured to screw into the inner part radial threads 113 described herein above. The outer part lower end 129 forms a well 125 configured to trap and retain fluid. The outer part 120 further includes at least one opening 126 disposed in the circumferential wall 121.

The at least one opening 126 in the circumferential wall 121 may be an array of openings disposed about the circumference of the circumferential wall 121. For example, the at least one opening may be four openings 126, as shown. Each of the four openings 126 includes a vertical portion 126*a*, a top horizontal portion 126*b* extending in a first direction from the vertical portion 126*a*, and a bottom horizontal portion 126*c* extending in a second direction from the vertical portion 126*a*, where the second direction is opposite the first direction. However, various other shapes and amounts of openings are contemplated. Whatever the shape and amount of openings, the openings may be configured to transfer fluid from within the confines of the outer part 120 to the exterior of the outer part 120 and into a fluid pipe, such as a shower drain or a floor drain or the like.

The well 125 may be defined by a solid bottom 127 of the outer part 120, and may hold an amount of water up to the bottom of the opening or openings 126. The bottom of the well may include a hook feature (not shown) configured to allow for ease of removal of the drain trap 100 by deploying a second hook tool (such as a hook of a clothes hanger).

Figure 15:
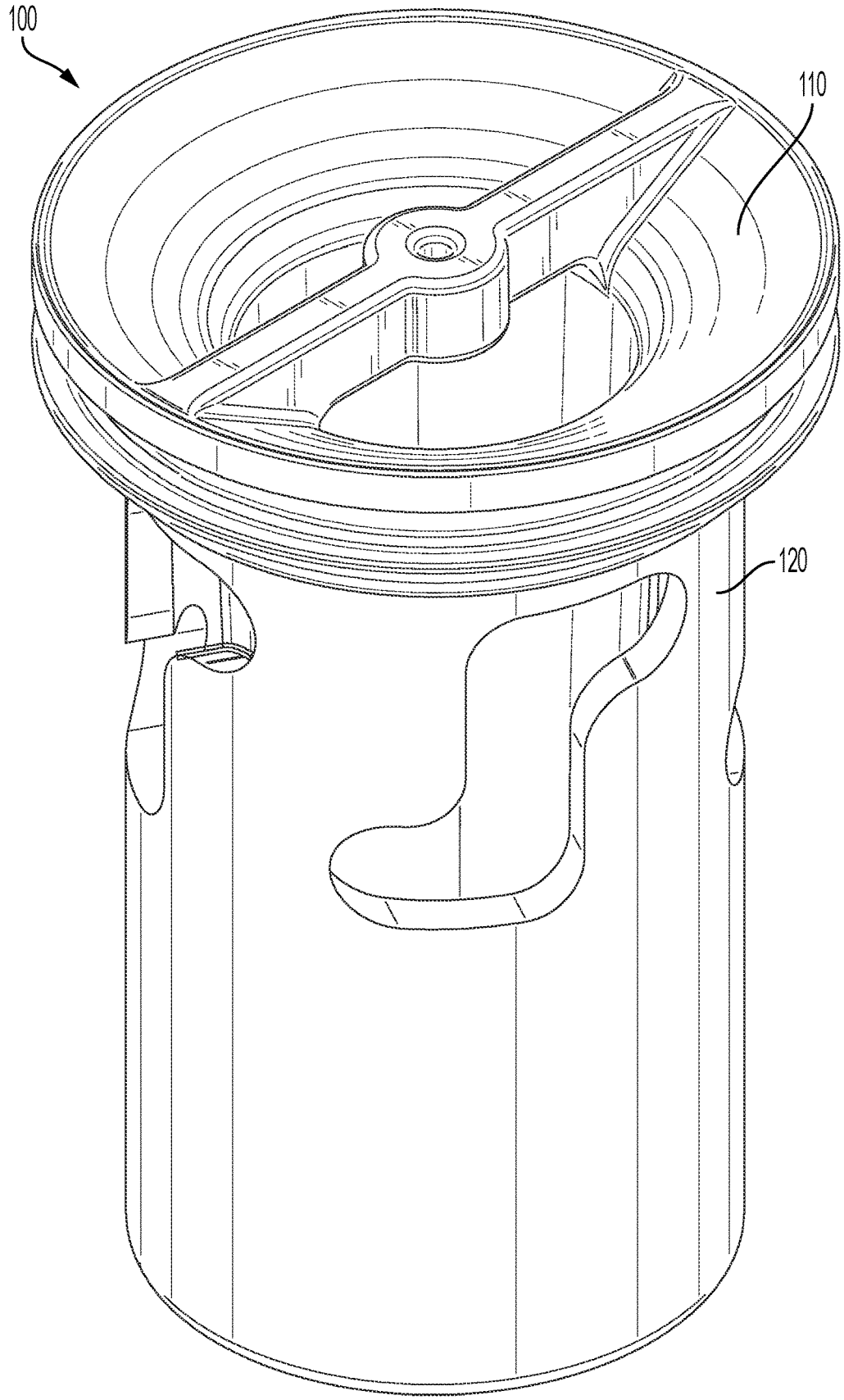
FIG. 15 is a perspective view of the drain trap of FIG. 1 including the outer part screwed together into the inner part, according to one embodiment.
Figure 16:
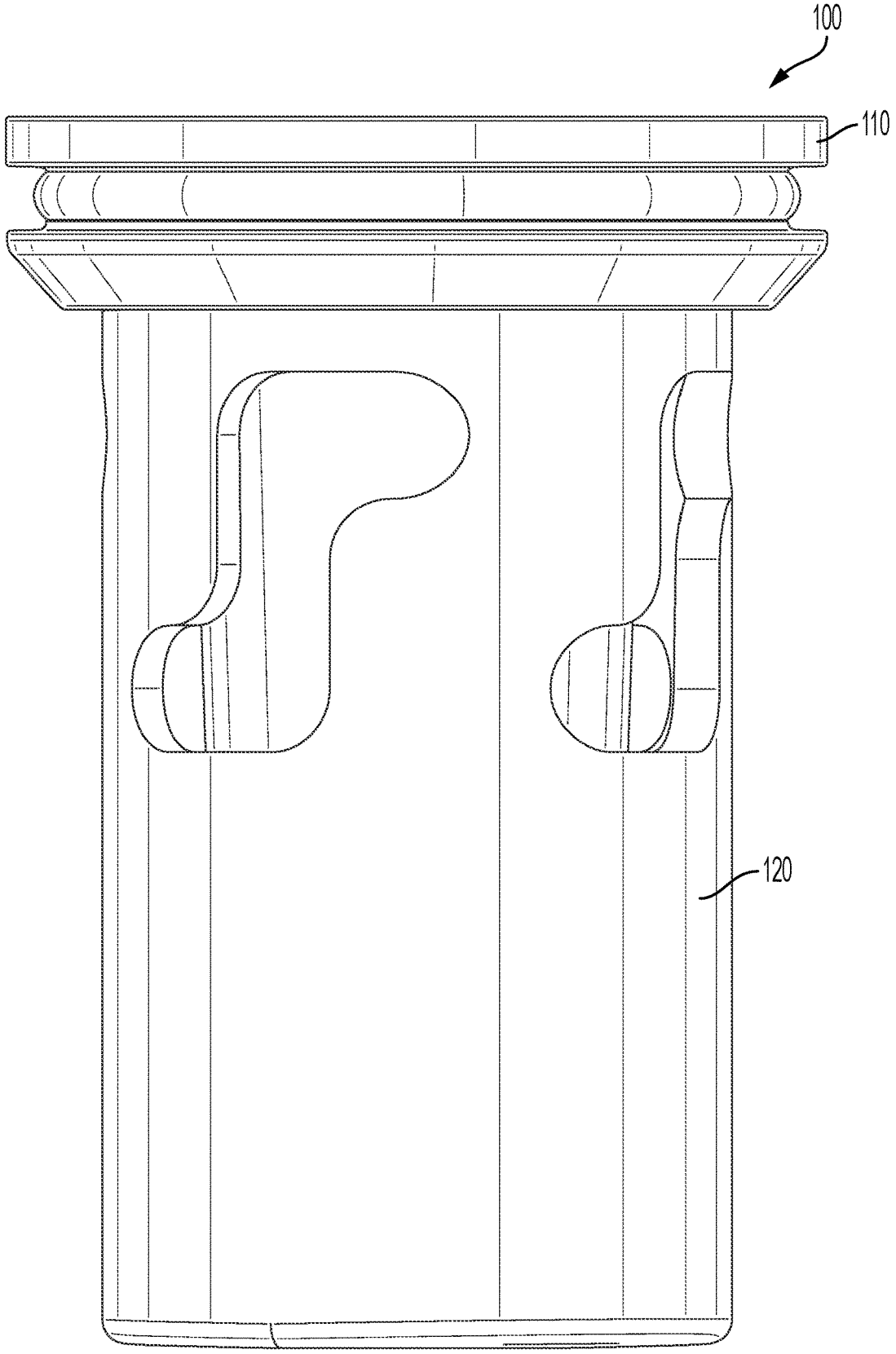
FIG. 16 is a front view of the drain trap of FIG. 1, according to one embodiment.
Figure 17:
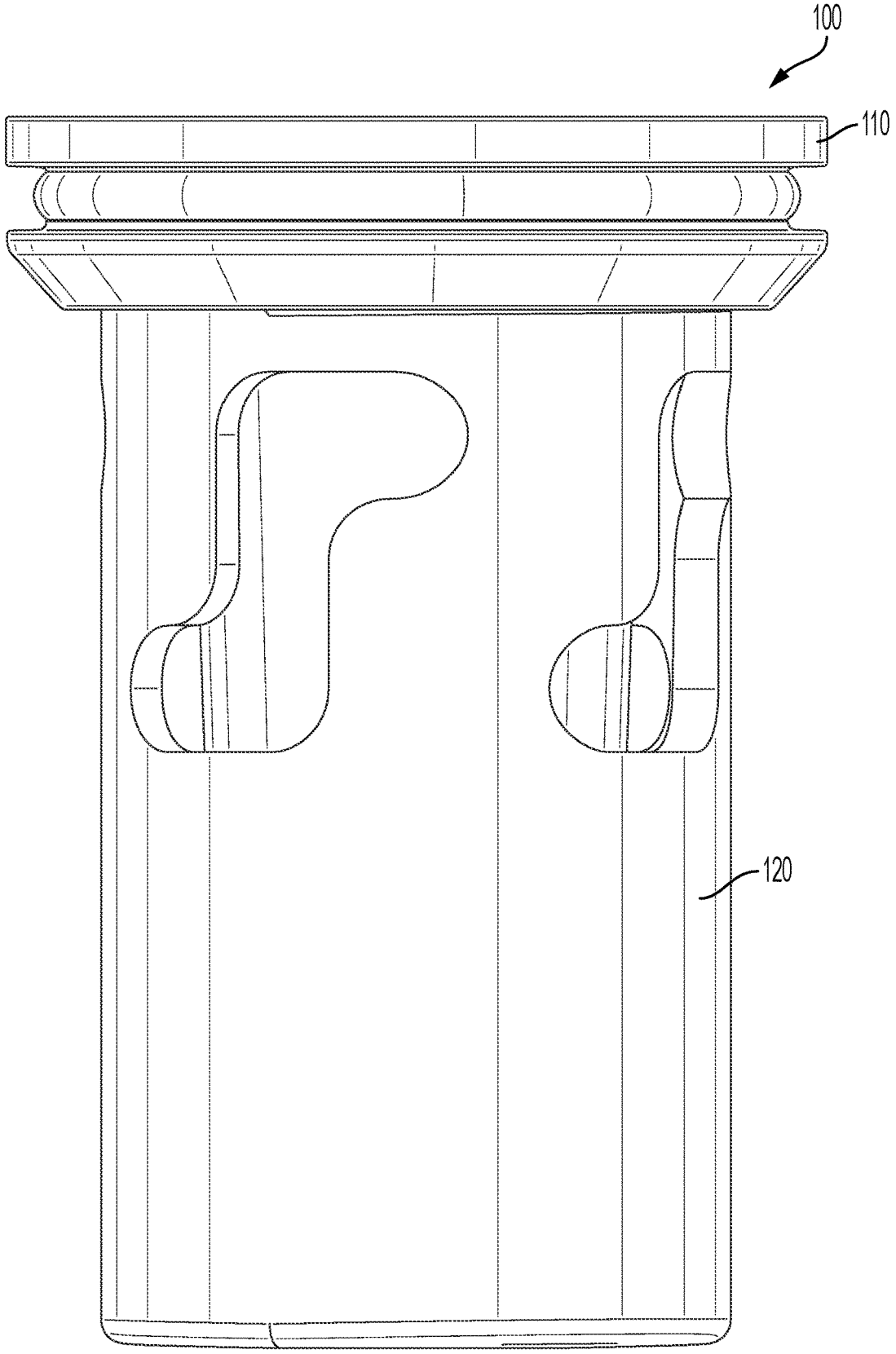
FIG. 17 is a left side view of the drain trap of FIG. 1, according to one embodiment.
Figure 18:
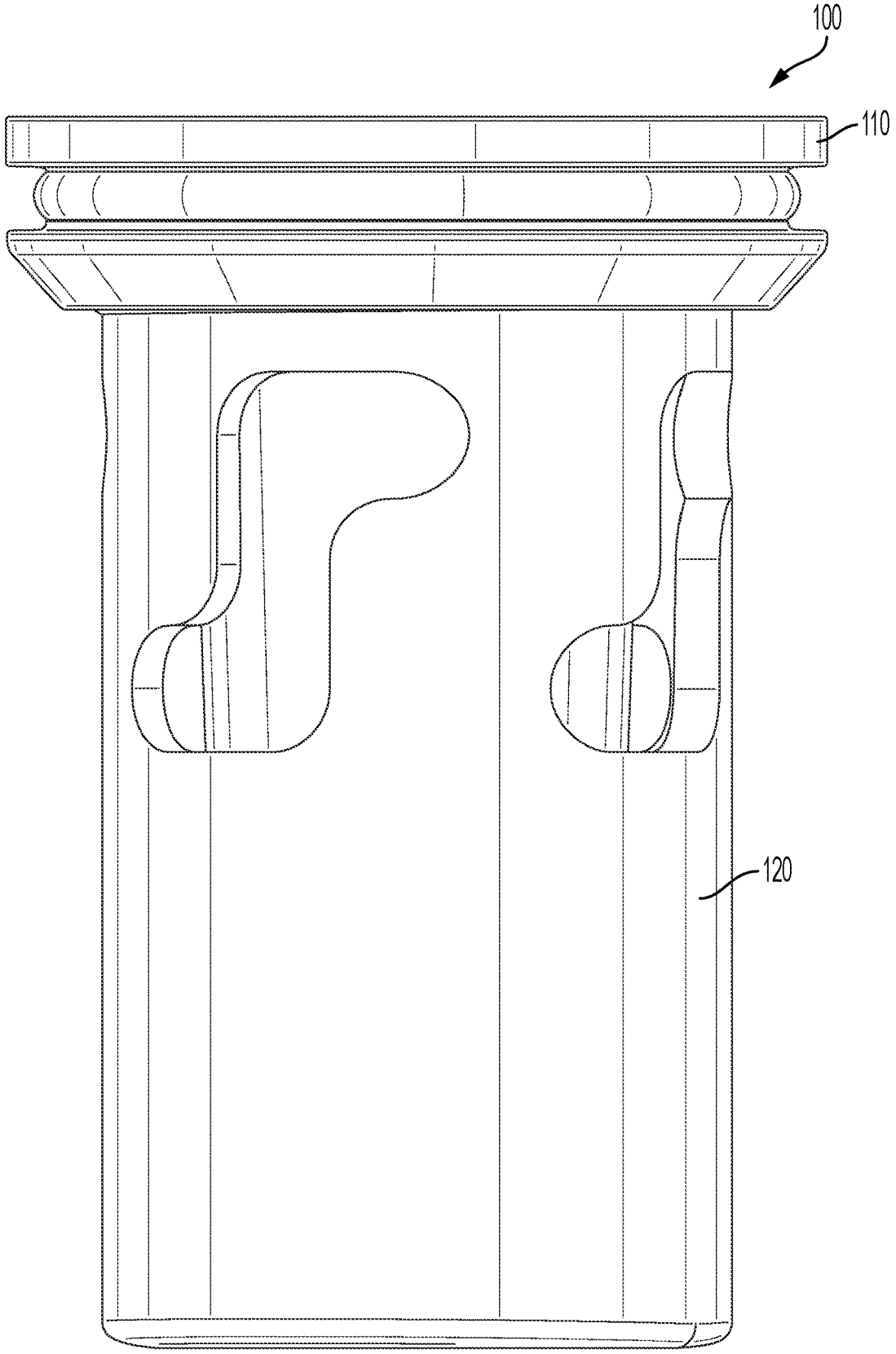
FIG. 18 is a right side view of the drain trap of FIG. 1, according to one embodiment.
Figure 19:
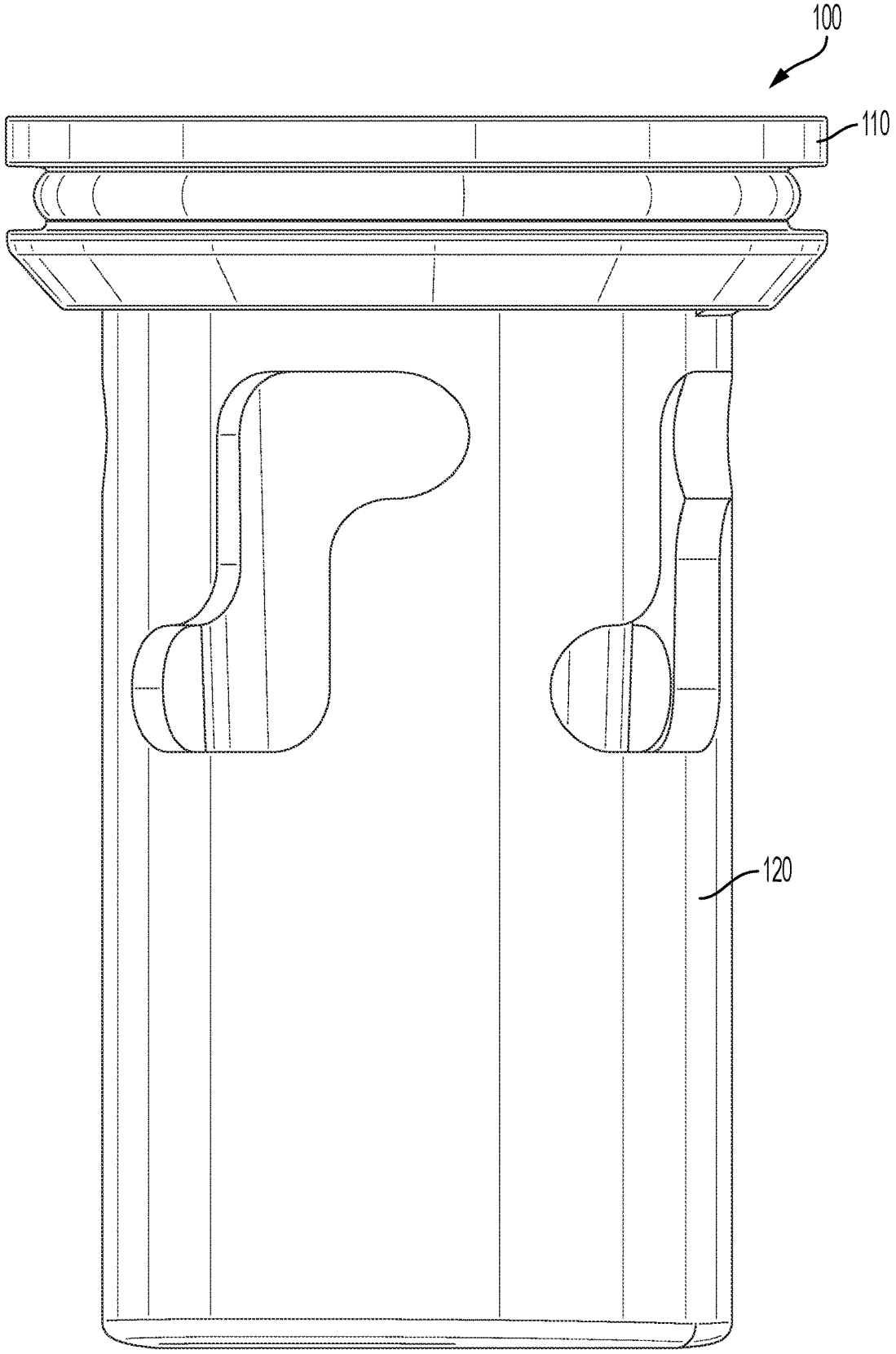
FIG. 19 is a rear view of the drain trap of FIG. 1, according to one embodiment.
Figure 20:
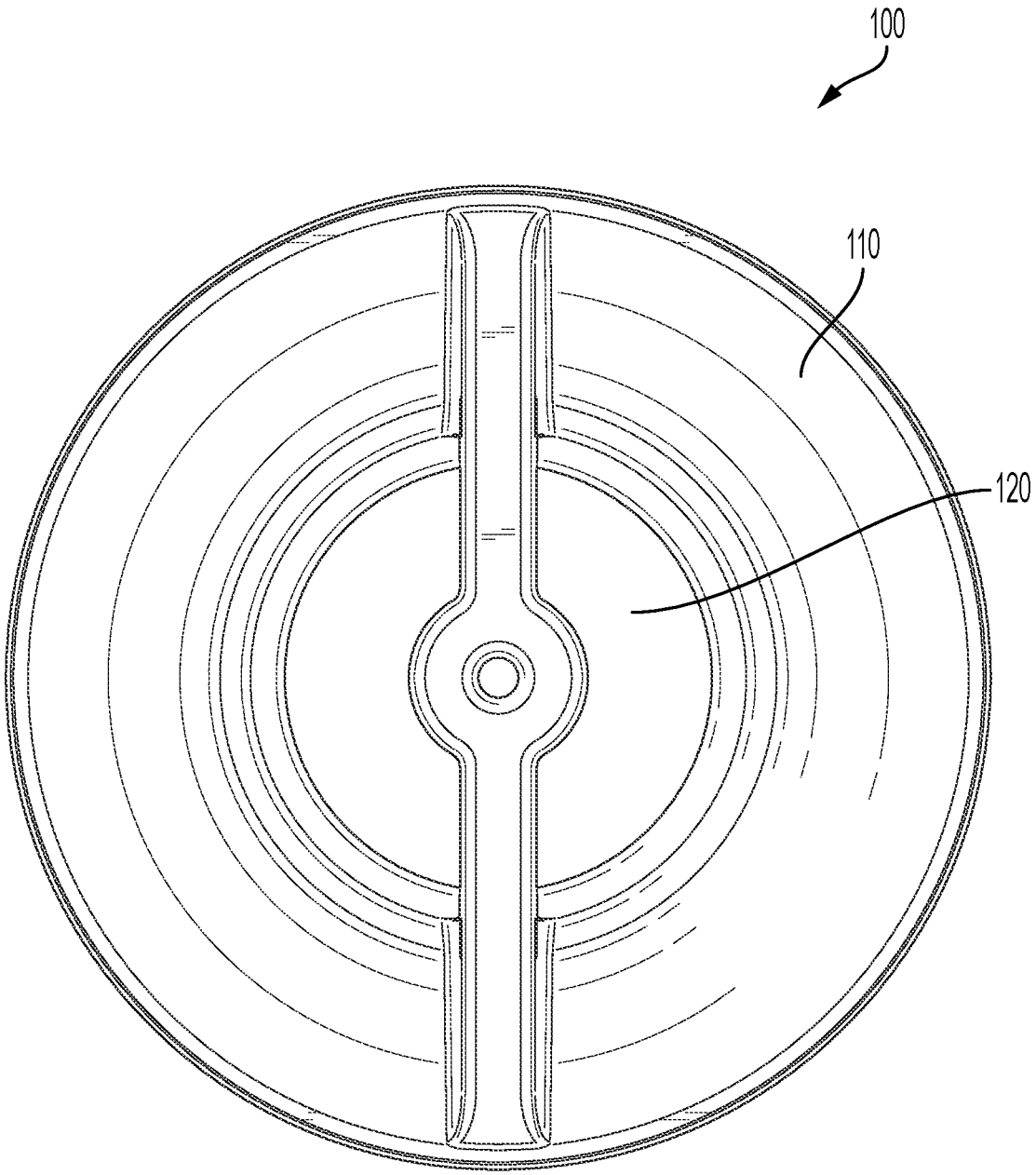
FIG. 20 is a top view of the drain trap of FIG. 1, according to one embodiment.
Figure 21:
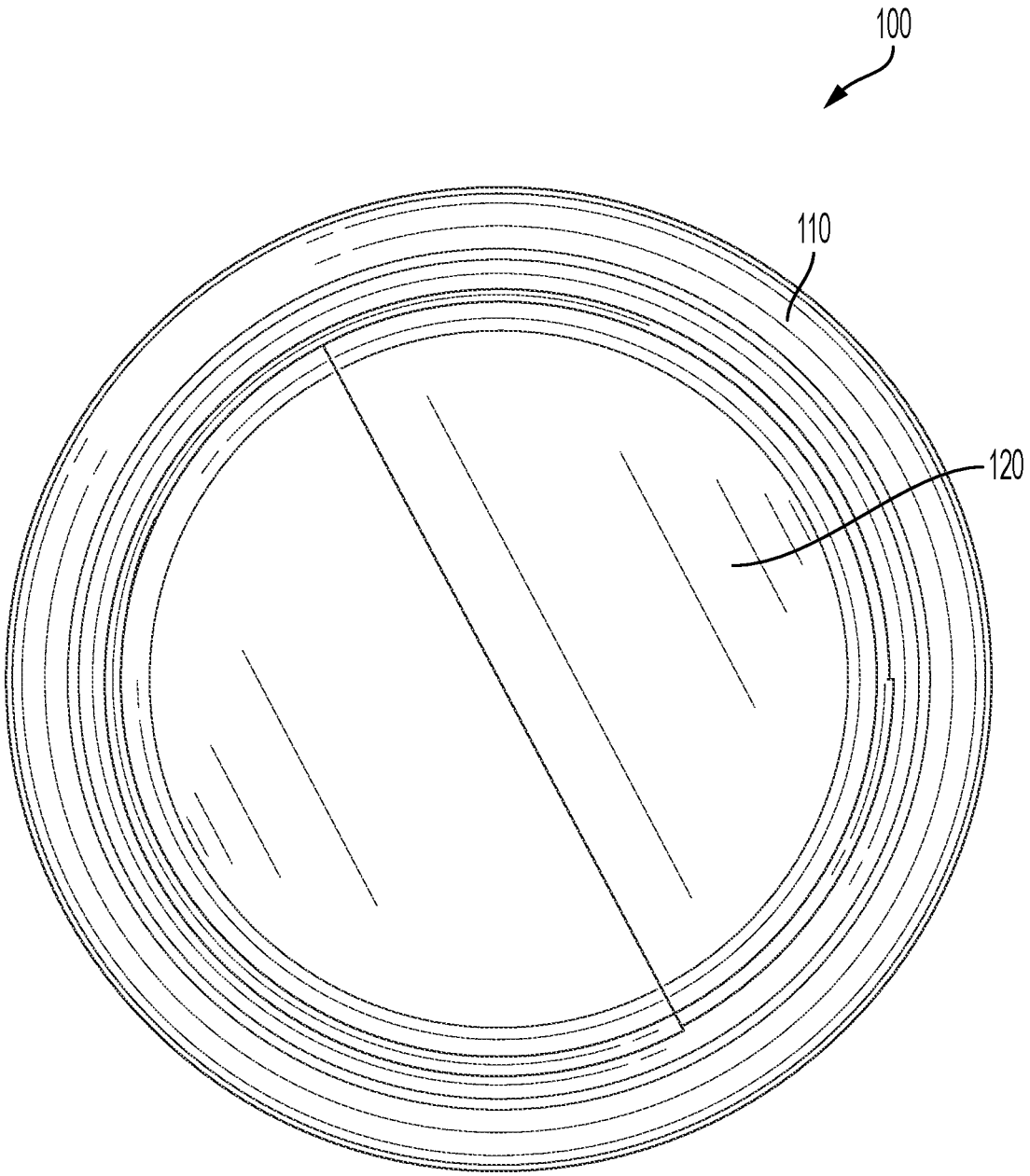
FIG. 21 is a bottom view of the drain trap of FIG. 1, according to one embodiment.

FIGS. 15-21 are views of the drain trap 100 including both the outer part 120 and the inner part 110 being attached together. In particular, FIG. 15 is a perspective view of the drain trap 100 of FIG. 1 including the outer part 120 screwed together into the inner part 110, FIG. 16 is a front view of both components of the drain trap 100, FIG. 17 is a left side view of both components of the drain trap of FIG. 1, FIG. 18 is a right side view of both components of the drain trap 100, FIG. 19 is a rear view of both components of the drain trap 100, FIG. 20 is a top view of both components of the drain trap 100, and FIG. 21 is a bottom view of both components of the drain trap 100.

At least one of the outer part upper end 128 and the inner part upper end 111 may include a larger circumference than a circumference circumferential wall 121 of the outer part 120. In the embodiment shown, the inner part upper end 111 includes the largest circumference of the drain trap 100, which provides for a mechanism to sit within the dimensions of a drain interface of a shower drain or a floor drain. In this manner, the drain trap 100 may be attachable, insertable or otherwise integrated into any type of fluid drain, such as a shower drain, a floor drain or the like.

In operation, fluid entering the drain trap 100 through the upper opening 114 of the inner part 110 flows down through the circumferential wall 119 of the inner part 110 and out the bottom opening 115 of the inner part 110, thereby being caught and accumulating in the well 125 at the bottom of the outer part 120. The fluid will then build in the well 125 until the height of the fluid exceeds the height of the openings 126 in the outer part 120, whereby the fluid entering the drain trap 100 is expelled from the drain trap 100 through the openings 126 disposed in the circumferential wall 121 of the outer part 120.

The drain trap 100 may further include an O-ring 130 made of a deformable material. The O-ring may be deployed proximate the threads 113, 124 of the inner part 110 and the outer part 120 in order to create a seal between the outer part and the inner part.

As shown, the height H1 of the inner part 110 may provide for the circumferential wall 119 of the inner part 110 to extend below a bottom height of the openings 126. Thus, the water accumulating in the well 125 of the outer part 120 will accumulate at a level above the inner part lower end 112 of the inner part 110. This ensure that water in the well provides a barrier against any odors arising from beneath the drain trap 100 in the shower drain, floor drain or the like. The O-ring 130 further helps to seal and prevent odors from escaping through the connection between the inner part 110 and the outer part 120.

Figure 22:
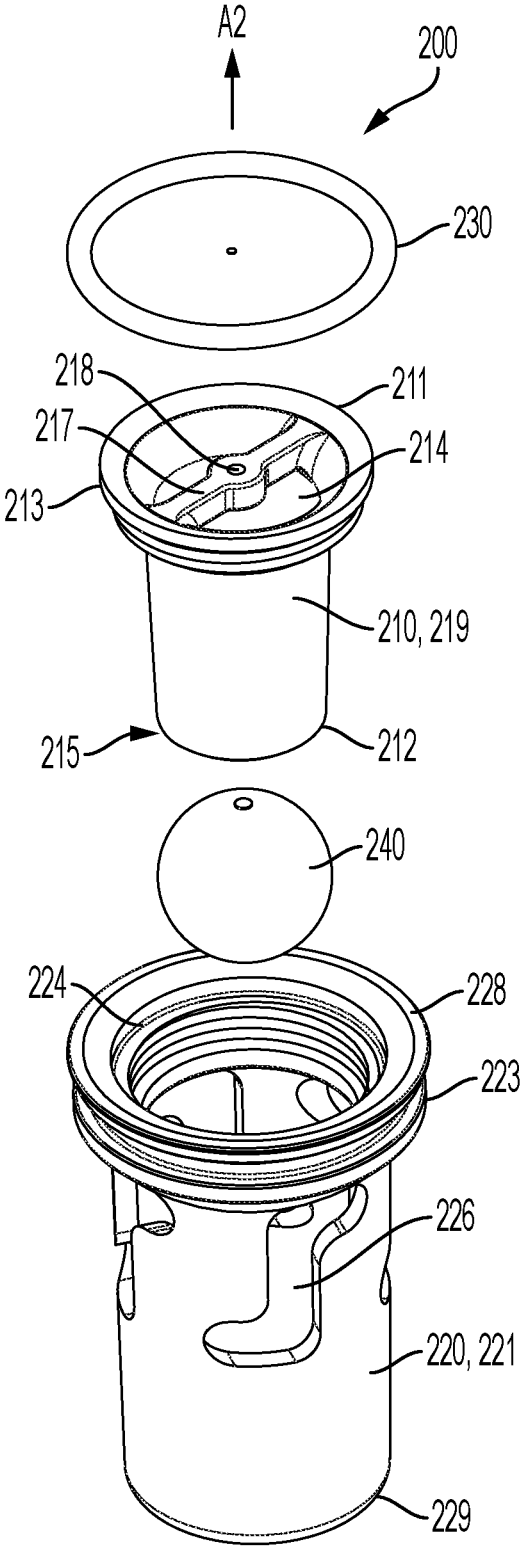
FIG. 22 is an exploded view of another drain trap, according to one embodiment.
Figure 23A:
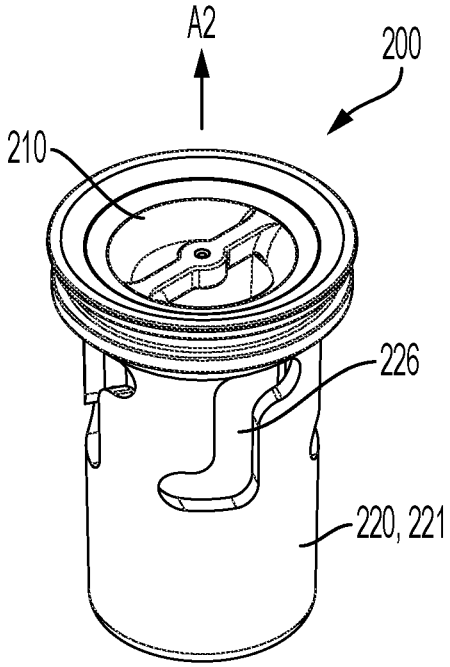
FIG. 23A is a perspective view of the drain trap of FIG. 22 showing a top of the drain trap, according to one embodiment.
Figure 23B:
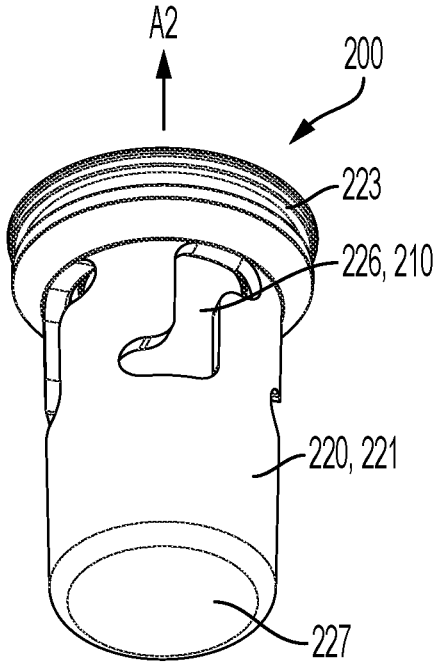
FIG. 23B is a perspective view of the drain trap of FIG. 22 showing a bottom of the drain trap, according to one embodiment.

Referring now to FIGS. 22-25B, another drain trap 200 is shown. In particular, FIG. 22 is an exploded view of another drain trap 200, according to one embodiment. FIG. 23A is a perspective view of the drain trap 200 showing a top of the drain trap 200, while FIG. 23B is a perspective view of the drain trap 200 showing a bottom of the drain trap 200, according to one embodiment. The drain trap 200 includes an inner part 210, an outer part 220, an O-ring seal 230 and a rounded structure 240.

The inner part 210 extends in an axial direction A2 between an inner part upper end 211 and an inner part lower end 212. The inner part 210 includes inner part radial threads 213 proximate the inner part upper end 211 configured to engage with outer part radial threads 224 of the outer part 220 to attach the inner part 210 to the outer part 220. The inner part upper end 211 includes an upper opening 214 and the inner part lower end 212 includes a bottom opening 215 such that fluid entering the inner part 210 through the upper opening 214 and leaving the inner part 210 through the bottom opening 215 is transferred into a well (shown in FIG. 25B) of the outer part 220 when the inner part 210 is attached to the outer part 220 (as shown in FIGS. 23A-25B).

At least one of the inner part 210 and the outer part 220 includes a radial O-ring seat 223 for receiving the O-ring 230. The O-ring 230 is configured to create a seal between the drain trap 200 and a fluid conduit (not shown). Unlike the embodiment shown in FIGS. 1-21, in the embodiment shown in FIGS. 22-25B, the outer part 220 includes the O-ring seat 223. In the embodiment shown, the O-ring seat 223 includes a circumferential channel configured to receive the O-ring seal 230.

The upper opening 214 of the inner part upper end 211 of the inner part 210 includes a cross beam structure 217 including an opening 218 configured to mount a screen (not shown). The upper opening 214 is configured to receive fluid from a reservoir into the drain trap 200 through the mounted screen. The upper opening 214 may include a conical structure which is funnel shaped and configured to funnel water through the inner part 210. The cross beam structure 217 extends across the conical structure. The opening 218 may include internal threads for receiving a bolt or screw for attaching the screen.

The inner part 210 includes a circumferential wall 219. The circumferential wall 219 of the inner part 210 includes a first height H3 (shown in FIG. 25B). The circumferential wall 219 may form a cylinder with a constant outer diameter along the height H2. Alternatively, as shown, the circumferential wall 219 may have a reduced outer diameter as the circumferential wall 219 extends away from the inner part upper end 211. Various shapes are contemplated for the circumferential wall 219. While the circumferential wall includes a circular circumference at any given location along the height H3, other embodiments may include varying cross sectional shapes.

The outer part 220 of the drain trap 200 is shown including a circumferential wall 221. The circumferential 221 wall of the outer part 220 includes a second height H4. The second height H4 is larger than the first height H3 of the inner part 210. Thus, the outer part 220 extends in the axial direction A2 between an outer part upper end 228 and an outer part lower end 229.

The outer part 220 includes outer part radial threads 224 proximate the outer part upper end 228. The outer part radial threads 224 shown are internal threads surrounding the interior of the circumferential wall 221 proximate the outer part upper end 228, and may be configured to receive the inner part radial threads 213, which are external threads. The outer part lower end 229 forms the well 225 (shown in FIG. 25B) configured to trap and retain fluid. The outer part 220 further includes at least one opening 226 disposed in the circumferential wall 221.

The at least one opening 226 in the circumferential wall 221 may be an array of openings disposed about the circumference of the circumferential wall 221. For example, the at least one opening may be four openings 226, as shown. Like the openings 126 described herein above, each of the four openings 126 includes a vertical portion, a top horizontal portion extending in a first direction from the vertical portion, and a bottom horizontal portion extending in a second direction from the vertical portion, where the second direction is opposite the first direction. However, various other shapes and amounts of openings are contemplated. Whatever the shape and amount of openings, the openings may be configured to transfer fluid from within the confines of the outer part 220 to the exterior of the outer part 220 and into a fluid pipe, such as a shower drain or a floor drain or the like.

The well 225 may be defined by a solid bottom 227 of the outer part 220, and may hold an amount of water up to the bottom of the opening or openings 226. The bottom of the well may include a hook feature 250 configured to allow for ease of removal of the drain trap 100 by deploying a second hook tool (such as a hook of a clothes hanger).

Figure 24A:
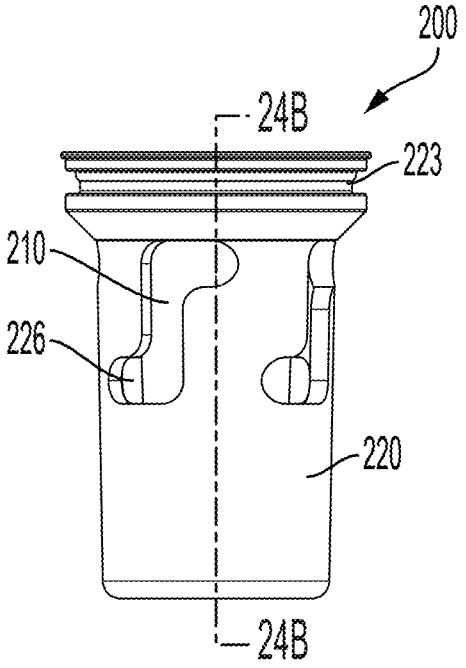
FIG. 24A is a side view of the drain trap of FIG. 22 in a first configuration according to one embodiment.
Figure 24B:
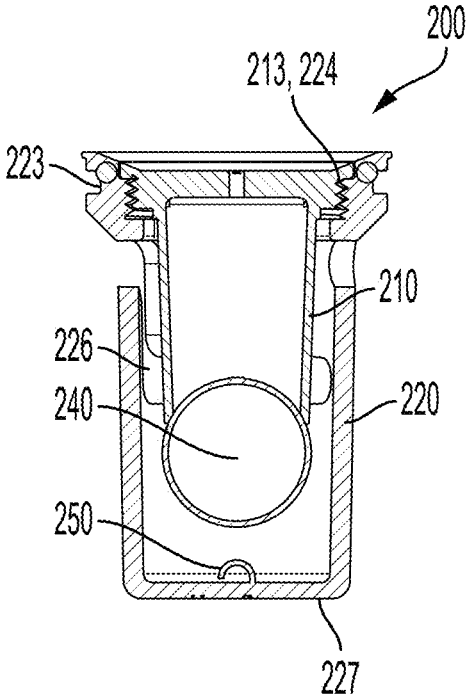
FIG. 24B is a side cutaway view of the drain trap of FIG. 24A, taken at arrows C-C, according to one embodiment.

FIG. 24A is a side view of the drain trap 200 in a first configuration while FIG. 24B is a side cutaway view of the drain trap 200 taken at arrows C-C. As shown the rounded structure 240 may be a sphere which rests within the well 225 when the drain trap 200 is assembled and in operation. A circumference of the sphere 240 is equal or larger than a circumference of the bottom opening 215 of the inner part 210. The rounded structure 240 may be retained within the well 225. The rounded structure 240 may be configured to float in the fluid received into the well 225, such as water or the like. The rounded structure 240 has a smaller dimension (e.g., diameter) than a width of the well 225, and an equal or larger dimension (e.g., diameter) than a width of the bottom opening 215 the inner part 210 such that the rounded structure 240 is prevented from rising in the well 225 by the inner part lower end 212.

Figure 25A:
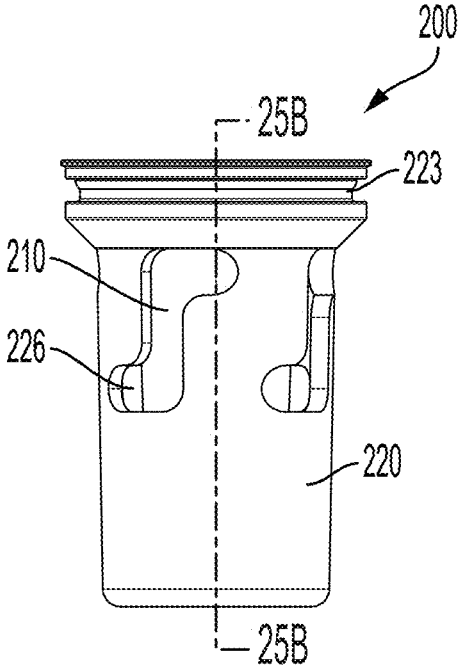
FIG. 25A is a side view of the drain trap of FIG. 22 in a second configuration according to one embodiment.
Figure 25B:
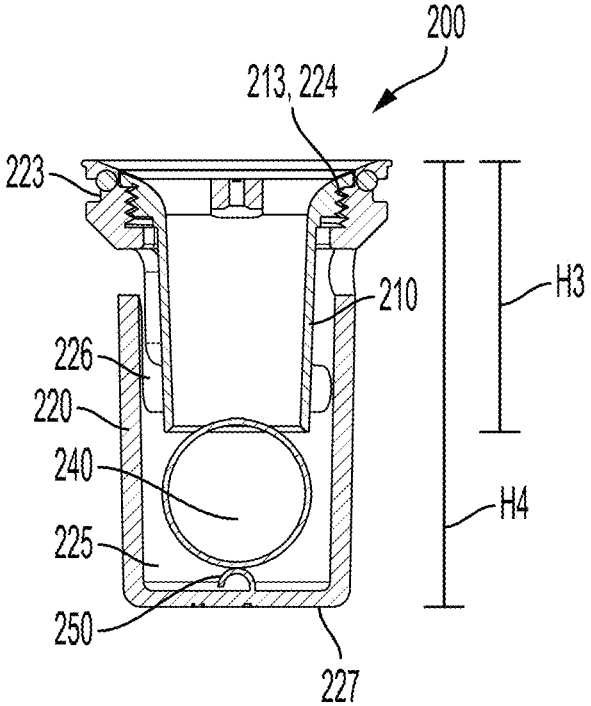
FIG. 25B is a side cutaway view of the drain trap of FIG. 25A, taken at arrows D-D, according to one embodiment.

FIG. 25A is a side view of the drain trap 200 in a second configuration while FIG. 25B is a side cutaway view of the drain trap 200 taken at arrows D-D. In the second configuration, the rounded structure 240 to a maximum level, whereby the rounded structure 240 is prevented from rising in the well 225 by the inner part lower end 212. This would occur in the instance that the well is full. Thus, when the well 225 is full and creating an odor bearer against any odors arising from beneath the drain trap 200 in the shower drain (as described herein above), the rounded structure further creates an additional odor barrier via its physical structure sealing against the inner part lower end 212 of the inner part 210.

While the rounded structure 240 has been shown as a hollow ball or sphere, any appropriate rounded shape is contemplated, such as an ellipsoid, egg shape, or the like. Whatever shape the rounded structure 240 encompasses, the rounded structure 240 may be hollow or solid. Whatever the shape, the rounded structure 240 may be configured to float within the well 225 and engage with the bottom opening 215 of the inner part 210 to create a seal therewith.

Furthermore, the rounded structure 240 may be made of a deformable or compliant material, such as a rubber or another appropriate polymer material in order to facilitate creating of a seal with the bottom opening 215 of the inner part 210. However, the rounded structure 240 may be made of any material. While the rounded structure 240 is shown as hollow, in other embodiments, the material may be a solid material, or may include a solid core which differs from the outer structure (such as a foam core).

Still further, the bottom opening 215 of the inner part 210 may be beveled or angled, as shown in FIGS. 24B and 25B. The bevel of the bottom opening 215 may be angled with a corresponding angle which matches an angle of the rounded structure 240 in order to facilitate sealing between the rounded structure 240 and the bottom opening 215 when the well 225 is full of fluid.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A drain trap comprising:

an outer part including a circumferential wall, the outer part extending in an axial direction between an outer part upper end and an outer part lower end, the outer part including outer part radial threads proximate the outer part upper end, the outer part lower end forming a well configured to trap and retain fluid, the outer part further including at least one opening disposed in the circumferential wall; and an inner part extending in the axial direction between an inner part upper end and an inner part lower end, the inner part including inner part radial threads proximate the inner part upper end configured to engage with the outer part radial threads of the outer part to attach the inner part to the outer part, wherein the inner part upper end includes an upper opening and the inner part lower end includes a bottom opening such that fluid entering the inner part through the upper opening and leaving the inner part through the bottom opening is transferred into the well of the outer part when the inner part is attached to the outer part, wherein fluid entering the drain trap accumulates in the well, and wherein the fluid entering the drain trap is expelled from the drain trap through the at least one opening disposed in the circumferential wall, and wherein the outer part radial threads are external threads, and wherein the inner part radial threads are internal threads.

2. The drain trap of claim 1, further comprising a rounded structure retained within the well, the rounded structure configured to float in the fluid, wherein the rounded structure has a smaller dimension than a width of the well, and an equal or larger dimension than a width of the bottom opening of the inner part such that the rounded structure is prevented from rising in the well by the inner part lower end.

3. The drain trap of claim 2, wherein the rounded structure is a sphere, and wherein a circumference of the sphere is equal or larger than a circumference of the bottom opening of the inner part.

4. The drain trap of claim 1, wherein the at least one opening in the circumferential wall is an array of openings disposed about the circumference of the circumferential wall.

5. The drain trap of claim 4, wherein the array of openings includes four openings, wherein each of the four openings includes a vertical portion, a top horizontal portion extending in a first direction from the vertical portion, and a bottom horizontal portion extending in a second direction from the vertical portion, wherein the second direction is opposite the first direction.

6. The drain trap of claim 1, wherein at least one of the inner part and the outer part includes an radial O-ring seat for receiving an O-ring seal.

7. The drain trap of claim 6, wherein the radial O-ring seat includes a circumferential channel configured to receive the O-ring seal.

8. The drain trap of claim 7, further comprising the O-ring made of a deformable material, the O-ring configured to create a seal between the drain trap and a fluid conduit.

9. The drain trap of claim 6, wherein the fluid conduit is a shower drain.

10. The drain trap of claim 6, wherein the fluid conduit is a floor drain.

11. The drain trap of claim 1, wherein the outer part radial threads are internal threads, and wherein the inner part radial threads are external threads.

12. The drain trap of claim 11, wherein the outer part includes a radial O-ring seat configured to receive an O-ring seal for creating a seal between the drain trap and a fluid conduit.

13. The drain trap of claim 12, wherein the upper opening of the inner part upper end includes an cross beam structure including an opening configured to mount a screen, wherein the upper opening is configured to receive fluid from a reservoir into the drain trap.

14. The drain trap of claim 1, wherein the inner part includes a radial O-ring seat configured to receive an O-ring seal for creating a seal between the drain trap and a fluid conduit.

15. The drain trap of claim 14, wherein the upper opening of the upper end of the inner part includes a cross beam structure including an opening configured to mount a screen, wherein the upper opening is configured to receive fluid from a reservoir into the drain trap.

16. The drain trap of claim 1, further comprising an O-ring made of a deformable material, the O-ring configured to create a seal between the outer part and the inner part.

17. The drain trap of claim 1, wherein a bottom of the well includes a hook feature.

18. The drain trap of claim 1, wherein the inner part includes an inner part circumferential wall.

19. The drain trap of claim 18, wherein the inner part circumferential wall includes a first height, and wherein the circumferential wall of the outer part includes a second height, and wherein the second height is larger than the first height.

20. The drain trap of claim 1, wherein at least one of the outer part upper end and the inner part upper end includes a larger circumference than a circumference circumferential wall of the outer part.

21. A drain trap comprising:

an outer part including a circumferential wall, the outer part extending in an axial direction between an outer part upper end and an outer part lower end, the outer part including outer part radial threads proximate the outer part upper end, the outer part lower end forming a well configured to trap and retain fluid, the outer part further including at least one opening disposed in the circumferential wall; and an inner part extending in the axial direction between an inner part upper end and an inner part lower end, the inner part including inner part radial threads proximate the inner part upper end configured to engage with the outer part radial threads of the outer part to attach the inner part to the outer part, wherein the inner part upper end includes an upper opening and the inner part lower end includes a bottom opening such that fluid entering the inner part through the upper opening and leaving the inner part through the bottom opening is transferred into the well of the outer part when the inner part is attached to the outer part, wherein fluid entering the drain trap accumulates in the well, and wherein the fluid entering the drain trap is expelled from the drain trap through the at least one opening disposed in the circumferential wall, and wherein a bottom of the well includes a hook feature.

22. A drain trap comprising:

an outer part including a circumferential wall, the outer part extending in an axial direction between an outer part upper end and an outer part lower end, the outer part including outer part radial threads proximate the outer part upper end, the outer part lower end forming a well configured to trap and retain fluid, the outer part further including at least one opening disposed in the circumferential wall; and an inner part extending in the axial direction between an inner part upper end and an inner part lower end, the inner part including inner part radial threads proximate the inner part upper end configured to engage with the outer part radial threads of the outer part to attach the inner part to the outer part, wherein the inner part upper end includes an upper opening and the inner part lower end includes a bottom opening such that fluid entering the inner part through the upper opening and leaving the inner part through the bottom opening is transferred into the well of the outer part when the inner part is attached to the outer part, wherein fluid entering the drain trap accumulates in the well, and wherein the fluid entering the drain trap is expelled from the drain trap through the at least one opening disposed in the circumferential wall, wherein the at least one opening in the circumferential wall is an array of openings disposed about the circumference of the circumferential wall, and wherein the array of openings includes four openings, wherein each of the four openings includes a vertical portion, a top horizontal portion extending in a first direction from the vertical portion, and a bottom horizontal portion extending in a second direction from the vertical portion, wherein the second direction is opposite the first direction.

* * * * *